US007121909B1

(12) United States Patent
Meyerhoffer

(10) Patent No.: US 7,121,909 B1
(45) Date of Patent: Oct. 17, 2006

(54) SYSTEM OF INTERCHANGEABLE COMPONENTS FOR CREATING A CUSTOMIZED WATERBOARD

(76) Inventor: Thomas Meyerhoffer, 1241 Main St., Montara, CA (US) 94037

( * ) Notice: Subject to any disclaimer, the term of this patent is extended or adjusted under 35 U.S.C. 154(b) by 0 days.

(21) Appl. No.: 11/118,135

(22) Filed: Apr. 29, 2005

(51) Int. Cl.
*A63C 5/03* (2006.01)

(52) U.S. Cl. ..... 441/74; 114/352

(58) Field of Classification Search ..... 441/65, 441/74; 114/39.14, 352
See application file for complete search history.

(56) References Cited

U.S. PATENT DOCUMENTS

| | | | | |
|---|---|---|---|---|
| 3,409,920 | A * | 11/1968 | Brownley | 441/74 |
| 3,879,782 | A * | 4/1975 | Oliver | 441/74 |
| 3,988,794 | A | 11/1976 | Tinkler et al. | |
| 3,996,868 | A * | 12/1976 | Schagen | 114/39.14 |
| D260,106 | S | 8/1981 | Peritz | |
| 4,598,659 | A | 7/1986 | Chinnery | |
| 4,619,619 | A | 10/1986 | Muse, Jr. | |
| 4,649,847 | A | 3/1987 | Tinkler et al. | |
| 4,807,549 | A * | 2/1989 | Rhodes et al. | 114/39.14 |
| 4,929,207 | A | 5/1990 | Piatt | |
| 4,963,111 | A | 10/1990 | Moulin | |
| 4,995,843 | A | 2/1991 | Englemann | |
| 5,174,220 | A | 12/1992 | Skedeleski et al. | |
| 5,195,444 | A | 3/1993 | Daniels | |
| 5,328,397 | A | 7/1994 | Whitty | |
| 5,425,321 | A | 6/1995 | Tinkler | |
| 5,464,359 | A | 11/1995 | Whitty | |
| 5,476,403 | A | 12/1995 | Hsia | |
| 5,514,018 | A | 5/1996 | Hara | |
| D377,072 | S | 12/1996 | Ilejay | |
| 5,672,081 | A | 9/1997 | Whitty | |
| 5,683,280 | A | 11/1997 | Winner | |
| 5,711,692 | A | 1/1998 | Pope | |
| 5,810,630 | A | 9/1998 | Saghri | |
| 5,816,179 | A | 10/1998 | Winner | |
| 5,975,974 | A | 11/1999 | McCausland | |
| 6,012,734 | A | 1/2000 | Skedeleski | |
| 6,059,621 | A | 5/2000 | Vogel | |
| 6,168,486 | B1 | 1/2001 | Lin | |
| 6,241,568 | B1 | 6/2001 | Simms | |
| 6,386,933 | B1 | 5/2002 | Rewald et al. | |
| 6,561,118 | B1 | 5/2003 | Mead | |
| 6,623,323 | B1 | 9/2003 | Mead | |
| 6,656,005 | B1 | 12/2003 | Meyerhoffer | |

FOREIGN PATENT DOCUMENTS

| | | |
|---|---|---|
| EP | 0 061 878 A2 | 10/1982 |
| GB | 2 336 132 A | 10/1999 |

* cited by examiner

*Primary Examiner*—Lars A. Olson
(74) *Attorney, Agent, or Firm*—Fenwick & West LLP

(57) ABSTRACT

A system of interchangeable components includes various front panels, rear panels, adaptors, and interfaces that can be variably and removably assembled to form various customized waterboards with various performance characteristics.

23 Claims, 39 Drawing Sheets

SYSTEM OF INTERCHANGEABLE COMPONENTS FOR CREATING A CUSTOMIZED WATERBOARD

BACKGROUND OF THE INVENTION

1. Field of the Invention

This invention relates generally to waterboards and, more specifically, to a system of components that can be assembled, disassembled, and re-assembled to form various customized waterboards.

2. Background Art

When evaluating a surfboard, a key factor is the board's performance characteristics. Performance characteristics affect how the board handles in the water and can vary widely from board to board. Although each board has its own performance characteristics, no single set of characteristics is ideal, since the surfing will be performed in a variety of situations, from different surf conditions to different rider skills and preferences.

One option is to buy several different surfboards, each with different performance characteristics. Then, different boards could be used at different times. This approach has many drawbacks. First of all, buying one surfboard can be expensive, let alone buying several. Also, this approach requires that several surfboards be brought along if the surf conditions are unknown. Thus, if the weather is highly variable or if the surfing will be done at some point in the future, several boards will have to be brought along just in case.

What is needed is a system of interchangeable components that can be assembled, disassembled, and re-assembled to form various surfboards with different performance characteristics. Such a system will be more affordable, more portable, and more useful than a collection of several surfboards.

SUMMARY OF THE INVENTION

A system of interchangeable components includes various front panels and rear panels that can be coupled to form various customized waterboards with various performance characteristics. The coupling is temporary so that a waterboard can be disassembled and its front panel and/or rear panel used to create other waterboards. In order to achieve different board performance characteristics, the panels have distinct performance characteristics. In one embodiment, panels vary in terms of shape, size, and composition (e.g., material and structure). A front panel and a rear panel can couple directly or via an additional component called an adaptor.

The system can also include an interface that creates flex between panels and/or adaptors. The interface is a flexible structure that is coupled to a panel or adaptor (the interface panel) and extends beyond an edge of that panel. The end of the interface that is coupled is called the anchor, while the opposite end (which is usually free-floating) is called the extension. When the interface panel is coupled to a second panel or adaptor, the extension end is located over, under, or inside the second panel (the receiving panel). A rider engages the interface by placing his body on the board such that his weight presses downwards on the interface, thereby bending it and flexing the board. In one embodiment, the interface is temporarily attached to the interface panel so that it can be placed in different positions or removed completely. In another embodiment, the interface is (removably) coupled to the receiving panel. In yet another embodiment, the interface panel includes one or more load-spreading elements that are coupled to the interface and that help transfer force to and from the interface.

The figures depict embodiments of the present invention for purposes of illustration only. One skilled in the art will readily recognize from the following discussion that alternative embodiments of the structures and methods illustrated herein can be employed without departing from the principles of the invention described herein.

DETAILED DESCRIPTIONS OF THE EMBODIMENTS

For simplicity purposes, the invention is described in the context of a system of components for creating a surfboard. However, the invention can be used to create any type of water sports board, including boogie boards, knee boards, wake boards, windsurfing boards, kite boards, and sail boards. For purposes of generality, the terms "surfboard" and "board" are used herein interchangeably and include any type of water sports board, such as surfboards, boogie boards, knee boards, wake boards, windsurfing boards, kite boards, sail boards, and any similar board used to permit walking, gliding, or planing on the surface of a body of water while sustaining the rider substantially out of contact with the water.

Figure 15A:
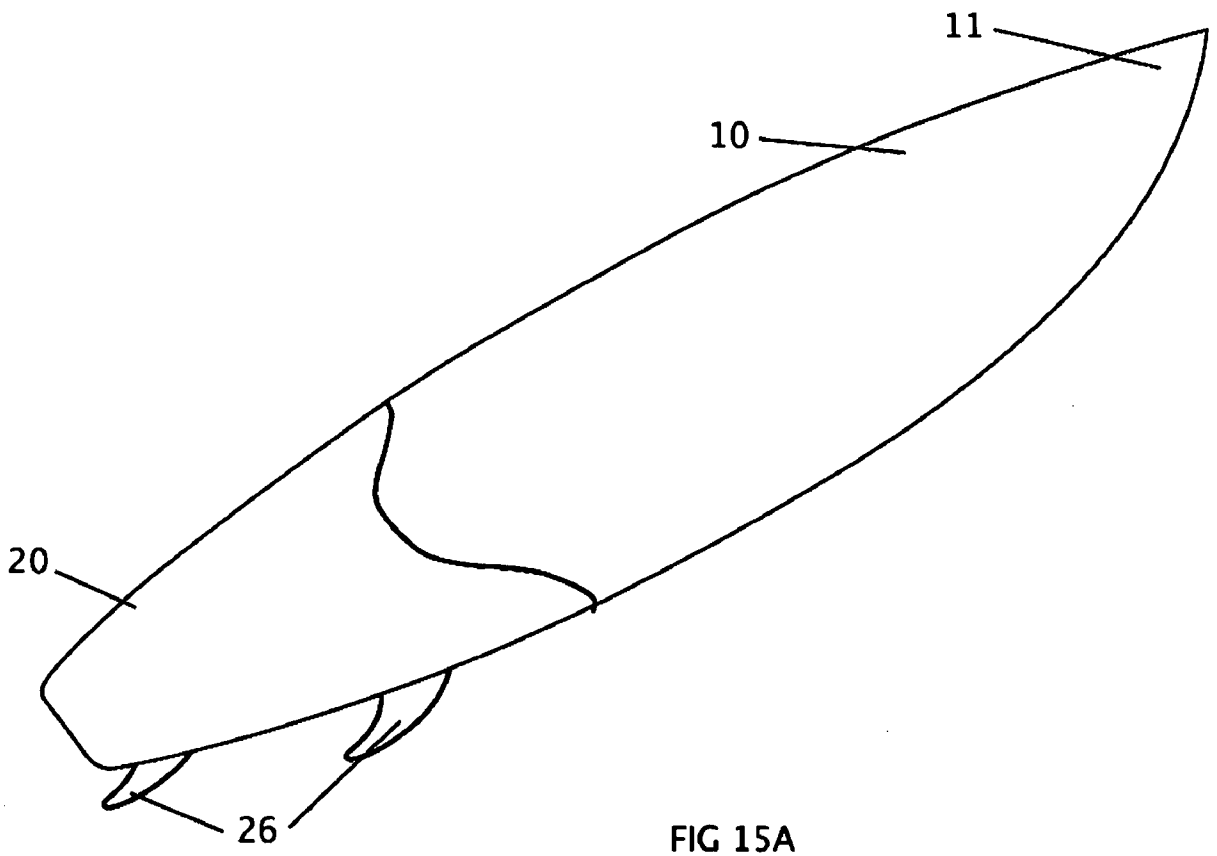
FIG. 15A shows a perspective view of a surfboard.
Figure 15B:
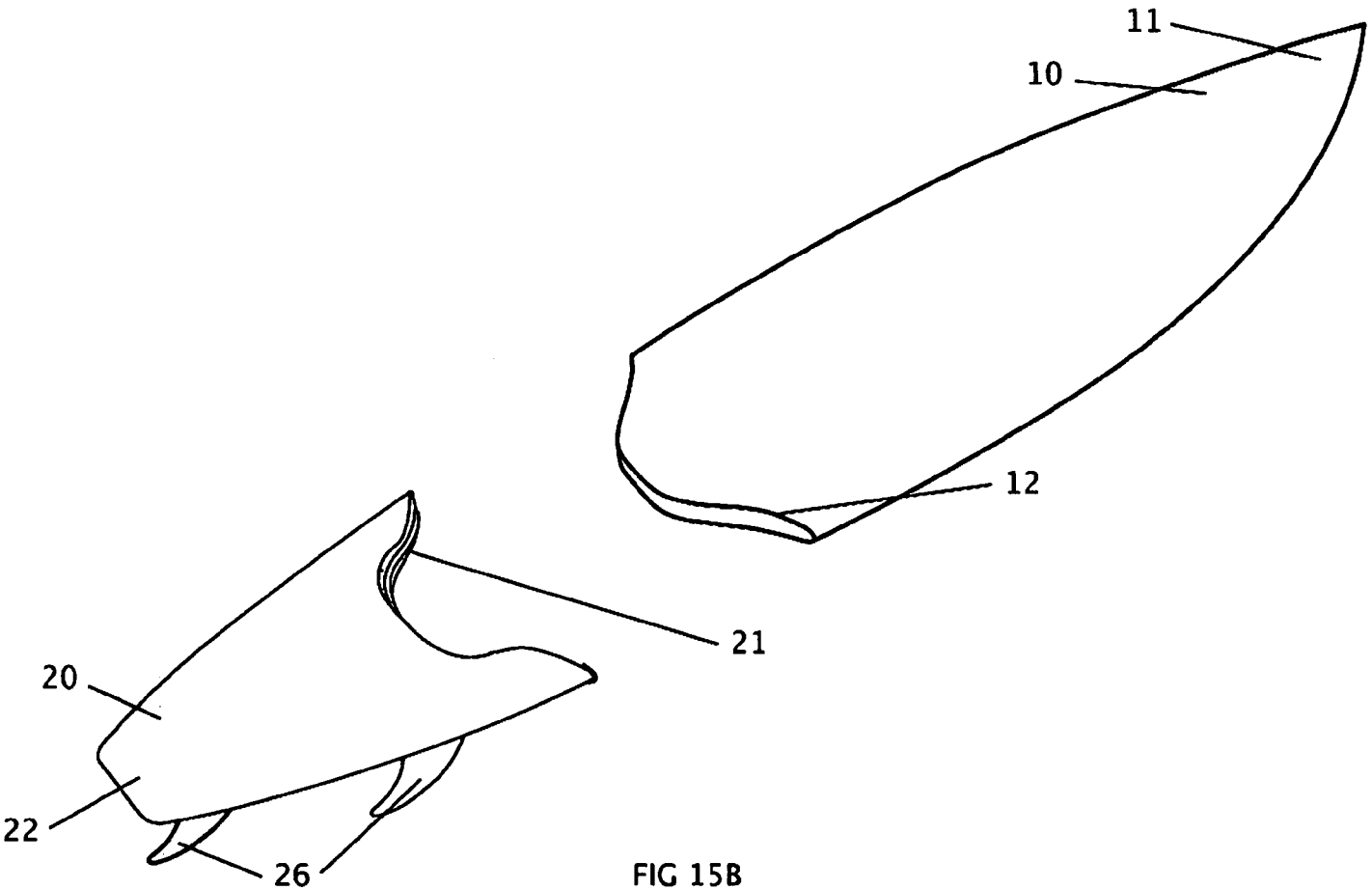
FIG. 15B shows an exploded perspective view of the surfboard shown in FIG. 15A.

A system of interchangeable components is used to form various surfboards with different performance characteristics. In one embodiment, the system includes one or more front panels and one or more rear panels. A surfboard is created by selecting a front panel, selecting a rear panel, and coupling them to form a substantially surfboard shape. FIG. 15A shows a perspective view of a surfboard. Here, the rear edge 12 of the front panel 10 is coupled to the front edge 21 of the rear panel 20. The coupling is temporary so that the front panel 10 can later be coupled to a different rear panel 20, and/or the rear panel 20 can later be coupled to a different front panel 10, thereby creating different boards with different performance characteristics. FIG. 15B shows an exploded perspective view of the surfboard shown in FIG. 15A. In this view, the front panel 10 has been decoupled from the rear panel 20. Depending on the sizes of the selected front panel 10 and the selected rear panel 20, the surfboard can be any length. In one embodiment, the surfboard's length falls within a range of 5.5 feet to 12 feet.

In order to achieve different board performance characteristics, the system includes one or more front panels 10 with different performance characteristics and one or more rear panels 20 with different performance characteristics. Performance characteristics are primarily determined by a board's shape, size, and composition (e.g., material and structure). Thus, in one embodiment, the system includes one or more front panels 10 with different shapes, sizes, and/or compositions and one or more rear panels 20 with different shapes, sizes, and/or compositions.

Front Panel

Figure 1C:
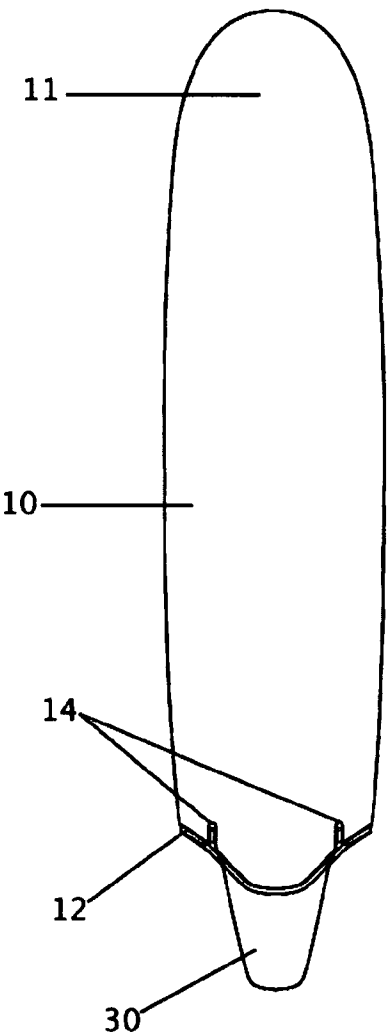
FIGS. 1A, 1B, and 1C show plan views of alternate embodiments of a front panel.
Figure 1B:
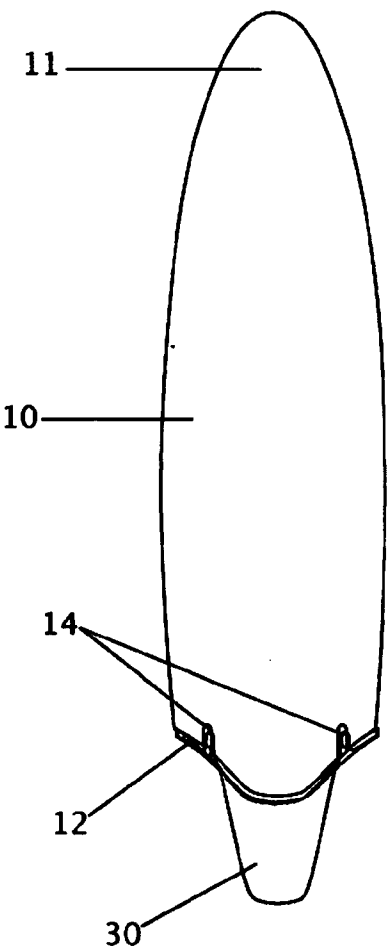
Figure 1A:
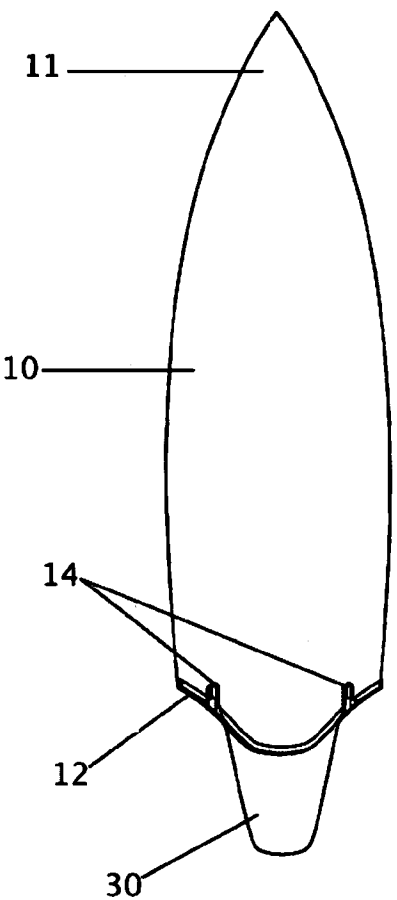

The shape of a front panel 10 can vary. For example, the shape of a front panel's front edge 11, which forms the nose of the surfboard, can vary. FIGS. 1A, 1B, and 1C show plan views of alternate embodiments of a front panel. FIG. 1A shows a front panel 10 with a pointed front edge 11, FIG. 1C shows a front panel 10 with a rounded front edge 11, and FIG. 1B shows a front panel 10 with a front edge 11 that is somewhat pointed and somewhat rounded.

As another example, the shape of a front panel's bottom surface (not shown), which contacts the water, can vary. In one embodiment, the bottom surface is flat. In another embodiment, the bottom surface is curved to form a rocker curve. In general, the larger the rocker curve, the easier it is to turn the board while riding. In yet another embodiment, the bottom surface includes one or more design features such as ridges, channels, or other concave or convex surfaces.

The size of a front panel 10 can also vary. For example, the panel 10 in FIG. 1A is shorter than the panel 10 in FIG. 1B, and the panel 10 in FIG. 1B is shorter than the panel in FIG. 1C. In one embodiment, the length of a front panel 10 falls within the range of 6.1 feet to 6.6 feet. In another embodiment, the front panel 10 is longer than the rear panel 20. In this embodiment, the front panel 10 forms the main body of the surfboard, while the rear panel 20 forms the tail of the surfboard.

In one embodiment, a front panel 10 can be made of multiple sub-panels that are coupled together, similar to how the surfboard is made of multiple panels. This embodiment is useful for several reasons. First, the front panel 10 can be further customized (e.g., by using different sub-panels with different performance characteristics). Also, the board as a whole is easier to transport, since it divides into smaller pieces. This can be very helpful if the front panel 10 is long.

Figure 2A:
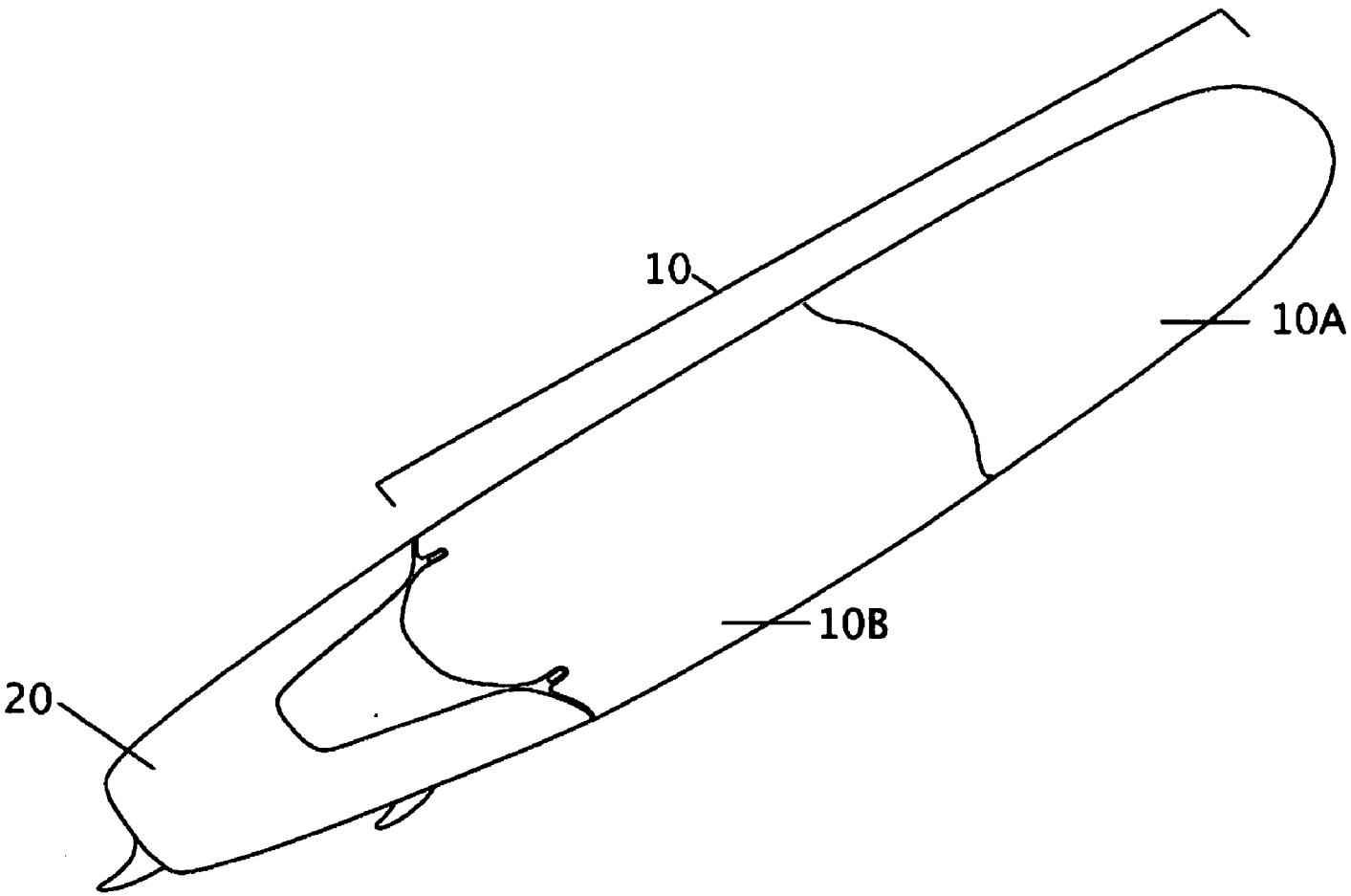
FIG. 2A shows a perspective view of a surfboard with a front panel that includes multiple parts.
Figure 2B:
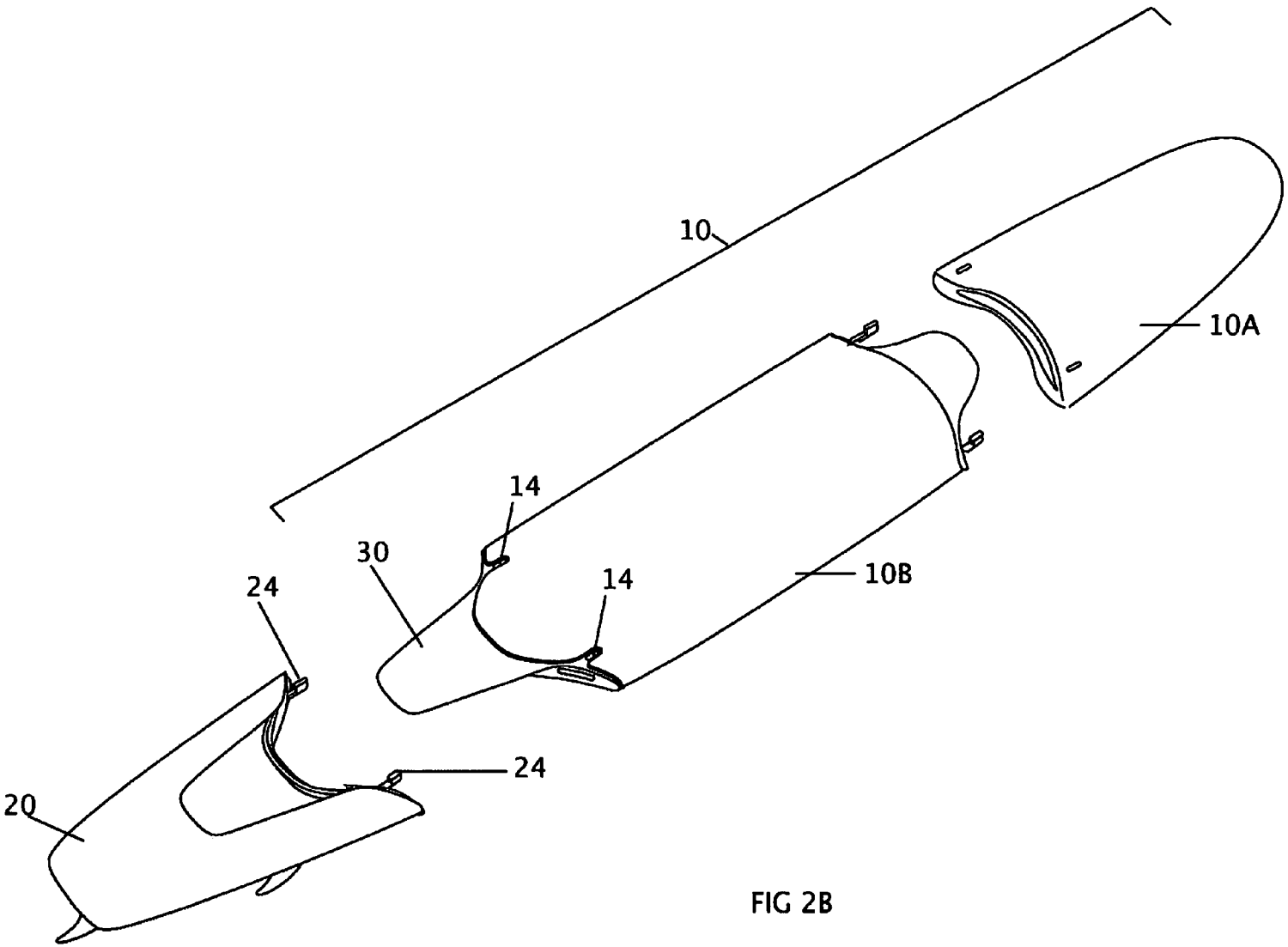
FIG. 2B shows an exploded perspective view of the surfboard shown in FIG. 2A.

FIG. 2A shows a perspective view of a surfboard with a front panel that includes multiple parts. Specifically, the front panel 10 includes a first sub-panel 10A and a second sub-panel 10B, which are coupled. The first sub-panel 10A forms the nose of the board, and the second sub-panel 10B couples to the rear panel 20. FIG. 2B shows an exploded perspective view of the surfboard shown in FIG. 2A. In this view, the first sub-panel 10A has been decoupled from the second sub-panel 10B, and the front panel 10 (specifically, the second sub-panel 10B) has been decoupled from the rear panel 20.

The coupling interface for the front panel 10 can be similar to that which is used to couple the front panel 10 and the rear panel 20. (This interface will be discussed below.) In one embodiment, the front panel 10 coupling interface has a different shape than the board coupling interface in order to fit within the overall outline of the surfboard, since the nose and the tail often have substantially different shapes. Also, the bottom surface of the front panel 10 would probably differ from the bottom surface of the board as a whole, which would necessitate a different coupling interface.

The composition of a front panel 10 can also vary. For example, a front panel 10 can be made of many different types of materials, such as a composite plastic skin laminated with fiberglass, carbon fiber, or a similar material. The panel 10 can be hollow, or it can contain filler. A panel 10 can be created by hand, mass production methods, or some of each. For example, a panel 10 can be injection molded and thermoformed. Manufacturing can also be controlled by a computer numerical control (CNC) machine. Filler, sometimes referred to as a "blank", can be obtained in an un-shaped, shaped, or semi-shaped state. Since filler is usually malleable, it can then be further shaped to preference (e.g., by hand or using a machine). Filler can be made of any material, such as wood or foam.

As another example, a front panel 10 can include one or more structural elements 13 (sometimes called "stringers"). These elements 13 add strength to a surfboard and can affect its overall flex, springiness, and feel. Also, force can be transferred from a rider to a structural element 13 and vice versa. The structural element 13 can then distribute this force to the bottom surface of the board (and, eventually, to the water).

In one embodiment, a structural element 13 connects to an interface (discussed below) that couples the front panel 10 and the rear panel 20. This enables the aforementioned force to be distributed to the interface. If the interface also connects to a structural element 23 in the rear panel 20, then the force can be distributed from the rider to the rear panel 20 (via the front panel 10 and the coupling interface). The force can also be distributed to one or more fins, if they are present in the front panel 10 and/or rear panel 20. (Fins will be discussed below in conjunction with rear panels 20.) Note that a structural element 13, 23 has no inherent "direction"—it enables force to flow freely between a rider, a front panel 10, a rear panel 20, and the water.

Just like a front panel 10, a structural element 13 can also vary in terms of its shape, size, and composition (e.g., material and structure). A structural element 13 can be made of any material, such as wood (e.g., cedar, spruce, balsa, redwood, or engineered wood), plastic (or composite plastic), fiberglass (or carbon fiber), or metal. A structural element 13 can also vary in terms of its location (e.g., relative to the rest of the front panel 10). It can be located, for example, within a panel 10 or on its surface. An element 13 located within a panel 10 would probably be incorporated during manufacturing, while an element 13 located on the surface of a panel 10 can be implemented as an attachment to a blank (e.g., by laminating it) or as an integrated part of a foam blank (e.g., by injection molding).

FIGS. 3A–G show plan views of alternate embodiments of a front panel. In these figures, the front edge 11 of the front panel 10 is not shown, since the shape of the front edge 11 can vary, as discussed above. Coupling mechanisms 14, which have not yet been discussed, are shown because of their possible interaction with the structural elements 13. In the illustrated embodiments, the coupling mechanisms 14 are connected to the rear edge 12 of the front panel 10. This enables force to be transferred from the coupling mechanisms 14 to the rear edge 12 of the front panel 10. The coupling mechanisms 14 in the front panel 10 connect to the coupling mechanisms 24 in the rear panel 20, both of which will be discussed below.

Figure 3D:
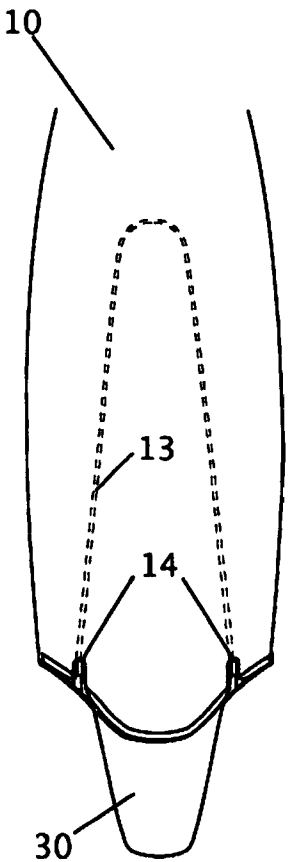
FIGS. 3A–G show plan views of alternate embodiments of a front panel.
Figure 3C:
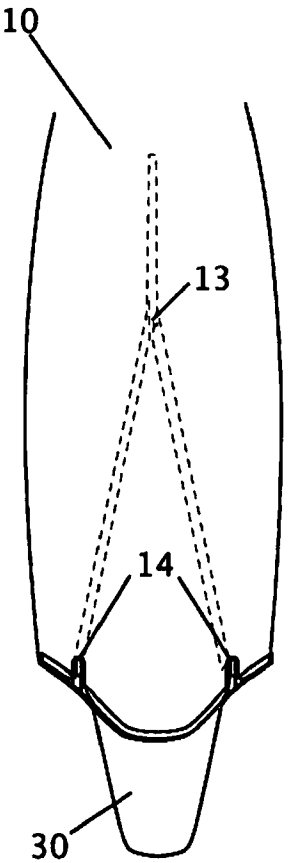
Figure 3B:
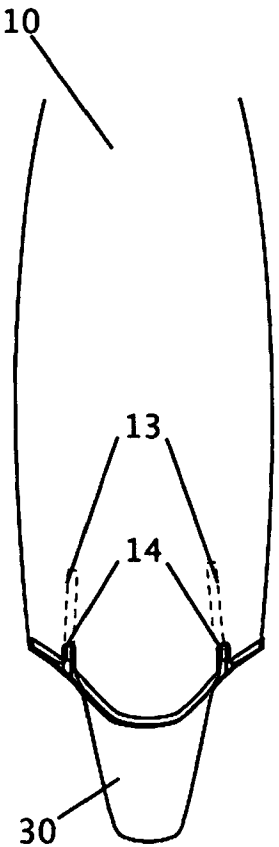
Figure 3A:
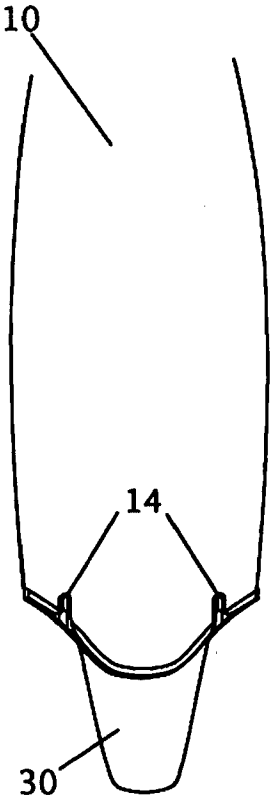

In FIG. 3A, the front panel 10 has no structural element 13. However, the front panel 10 can have other structural features, such as areas of its skin that have been reinforced with different material characteristics.

In FIG. 3B, the front panel 10 has two straight structural elements 13, one on its left side and one on its right side. These elements 13 extend forward (at a slight angle towards the front panel's midline) from the coupling mechanisms 14. Since the structural elements 13 connect to the coupling mechanisms 14, they can transfer force to them. In the illustrated embodiment, the structural elements 13 are shown with dashed lines, indicating that they are not visible from the top surface of the front panel 10. This may be because, for example, the elements 13 are located inside the front panel 10.

In FIG. 3C, the front panel 10 has a structural element 13 that connects to the two coupling mechanisms 14 and the front edge 11 (not shown). In the illustrated embodiment, the portions of the structural element 13 that connect to the coupling mechanisms 14 form an upside-down wedge ("v") shape. In FIG. 3D, the front panel 10 has a structural element 13 that connects to the coupling mechanisms 14 and does not connect to the front edge 11 of the front panel 10. In the illustrated embodiment, the structural element 13 forms an elongated, upside-down "u" shape.

Figure 3G:
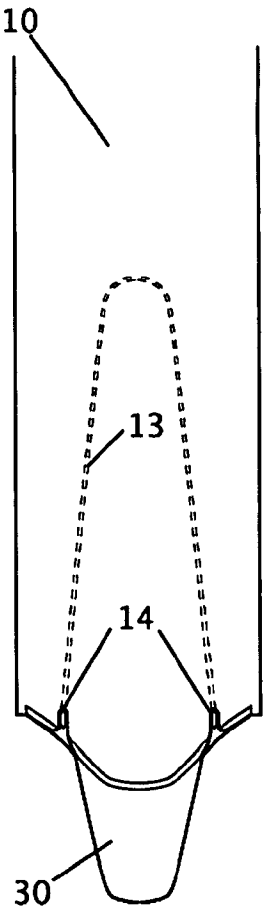
Figure 3F:
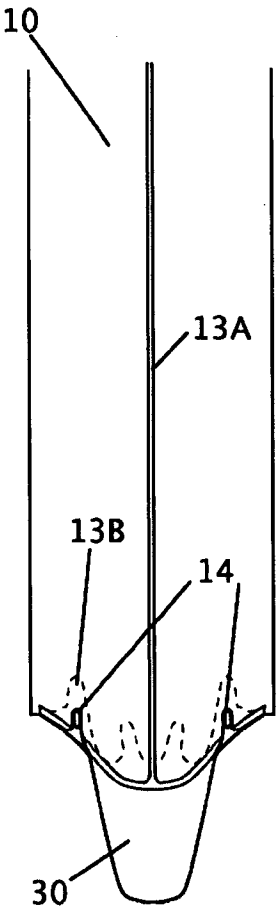
Figure 3E:
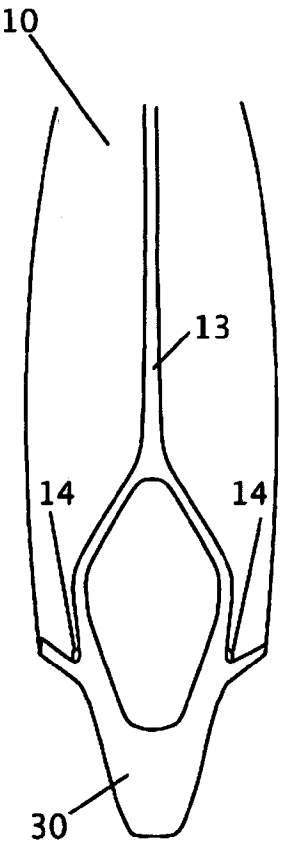

In FIG. 3E, the structural element 13 is shown with solid lines, which indicates that the structural element 13 is visible from the top surface of the front panel 10. This may be because, for example, the element 13 is located on top of, or embedded in the top surface, and preferably flush with it. The structural element 13 in FIG. 3E is similar to the structural element 13 in FIG. 3C, in that they both connect to the coupling mechanisms 14 and the front edge 11 (not shown).

In FIG. 3F, two structural elements 13A, 13B are shown. The first structural element 13A is straight, extends from coupling mechanisms 14 to the front edge 11 (not shown), and is visible from the top surface. The second structural element 13B includes a plurality of curves and connects to the rear edge 12 of the front panel 10 in two places. Note that the left and right edges of the front panel 10 in the illustrated embodiment are straight instead of curved. This indicates that the panel 10 has not yet been shaped (e.g., the "panel" is actually an un-shaped blank that has the second structural element 13B integrated into it during manufacturing).

The structural element 13 in FIG. 3G is similar to that shown in FIG. 3D, except that it has been integrated into an un-shaped block (as indicated by the straight left and right edges of the front panel 10).

FIGS. 3A, 3B, 3C, 3D, 3E, 3F, and 3G show only a few embodiments of a front panel 10. Other types of structural elements 13 can include, for example, rods, beams, and one or more stringers in various configurations, such as a single stringer down the midline, multiple parallel single stringers, one stringer or multiple stringers in a wedge shape, a double T-band stringer, and a triple T-band stringer. In addition, structural elements 13 can differ in terms of shape, size, composition (e.g., material and structure), and location (e.g., relative to the rest of the front panel 10).

Rear Panel

Figure 4C:
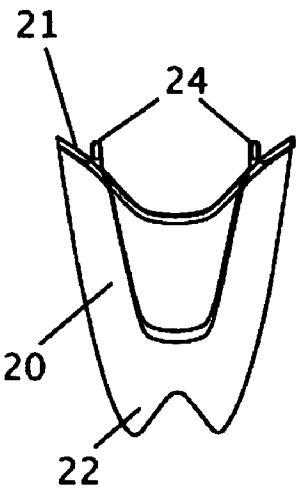
FIGS. 4A–F show plan views of alternate embodiments of a rear panel.
Figure 4B:
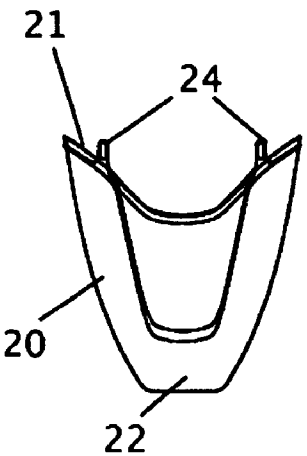
Figure 4A:
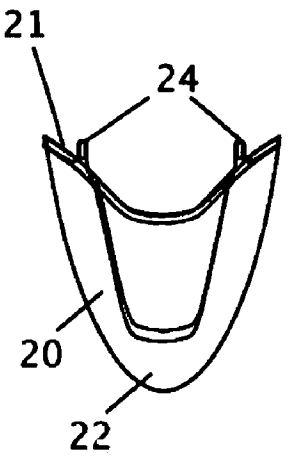
Figure 4F:
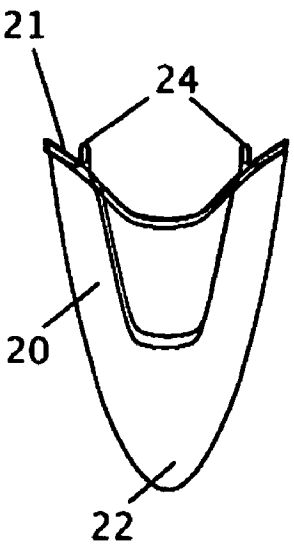
Figure 4E:
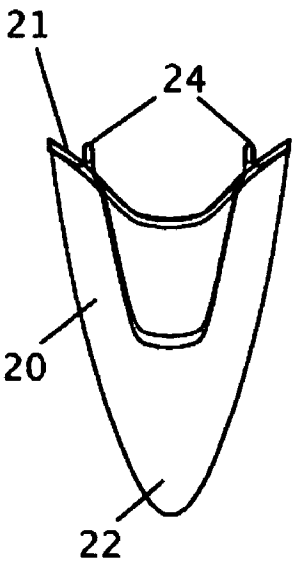
Figure 4D:
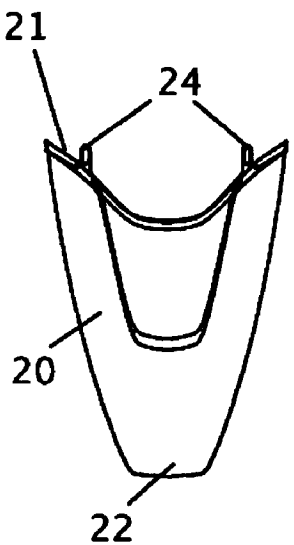

Rear panels 20 are similar to front panels 10 in that their shapes and sizes can vary. For example, the shape of a rear panel's rear edge 22, which forms the tail of the surfboard, can vary. Also, the length of a rear panel 20 can vary. In one embodiment, the rear panel 20 is shorter than the front panel 10. In this embodiment, the rear panel 20 forms the tail of the surfboard, while the front panel 10 forms the main body of the surfboard. FIGS. 4A–F show plan views of alternate embodiments of a rear panel. In order, the illustrated rear panels 20 are: short with a rounded rear edge 22 (sometimes called a "pin tail"; FIG. 4A), short with a blunt rear edge 22 (sometimes called a "squash tail"; FIG. 4B), somewhat short with a forked rear edge 22 (sometimes called a "swallow tail"; FIG. 4C), somewhat long with a blunt rear edge 22 (FIG. 4D), somewhat long with a rounded rear edge 22 (FIG. 4E), and long with a pointy but somewhat rounded rear edge 22 (sometimes called a "pin tail"; FIG. 4F).

As another example, the shape of a rear panel's bottom surface (not shown), which contacts the water, can also vary. In one embodiment, the bottom surface is flat. In another embodiment, the bottom surface is curved to form a rocker curve. In general, the larger the rocker curve, the easier it is to turn the board while riding. In yet another embodiment, the bottom surface includes one or more design features such as ridges, channels, or other concave or convex surfaces.

The composition (e.g., material and structure) of a rear panel 20 can also vary, similar to that described above in conjunction with front panels 10. In particular, a rear panel 20 can be made from a blank and can include one or more structural elements 23. These structural elements 23 are similar to those described above 13 in conjunction with front panels 10 and can be located, for example, within the rear panel 20 or on its surface. In particular, they can connect to an interface (discussed below) that couples the rear panel 20 and the front panel 10. This enables force to be transferred to the interface. If the interface also connects to a structural element 13 in the front panel 10, then the force can be transferred from the rear panel 20 to the rider (via the coupling interface and the front panel 10).

Unlike front panels 10, rear panels 20 usually include one or more fins 26. In one embodiment, a rear panel 20 includes anywhere from one to five fins 26. A fin 26 can vary in terms of shape, size, composition (e.g., material and structure), and location (e.g., relative to the rest of the rear panel 20). A structural element 23 can also connect to one or more of these fins 26. This enables force to be transferred between the water, the fin 26, the structural element 23, and the coupling mechanism 24.

A fin 26 can connect to a rear panel 20 using a variety of mounting mechanisms. In one embodiment, the mounting mechanism is permanent, so that once a fin 26 has been attached, it cannot be removed. In another embodiment, the mounting mechanism is temporary, so that various fins 26 can be attached and removed as desired. A mounting mechanism can also strengthen the rear panel 20 and reinforce its structure.

One example of a temporary mounting mechanism is a fin cassette 27. While the fin cassette 27 is located such that the fin 26 extends downward into the water, its exact placement relative to the rear panel 20 can vary. In one embodiment, the fin cassette 27 is attached to the bottom surface of the rear panel 20 so that, if the bottom surface were facing upward, the cassette 27 would appear to be located on top of the rear panel 20. In another embodiment, the cassette 27 is located partially inside the rear panel 20 so that one of its edges is flush with the bottom surface. In this embodiment, the cassette 27 can either extend partway into the panel (so that the cassette's top edge is inside the panel) or it can extend through the panel (so that the cassette's top edge is flush with the top surface of the panel). In one embodiment, a fin cassette 27 is temporarily attached to the rear panel 20 so that various types of cassettes can be attached and removed as desired. Other types of fins and fin mounting mechanisms, both permanent and temporary, are known to those of ordinary skill in the art.

A structural element 23 in a rear panel 20 can vary in terms of its shape, size, composition (e.g., material and structure), and location. For example, a structural element 23 can vary based on the overall shape and size of the rear panel 20 and the placement of one or more fins 26. FIGS. 5A–F show plan views of alternate embodiments of a rear panel. In these figures, the rear edge 22 of the rear panel 20 is sometimes not shown, since the shape of the rear edge 22 can vary, as discussed above. Coupling mechanisms 24, which have not yet been discussed, are shown because of their possible interaction with the structural elements 23. In the illustrated embodiments, the coupling mechanisms 24 are connected to the front edge 21 of the rear panel 20. This enables force to be transferred from the front edge 21 of the rear panel 20 to the coupling mechanisms 24. The coupling mechanisms 24 in the rear panel 20 connect to the coupling mechanisms 14 in the front panel 10, both of which will be discussed below.

Figure 5C:
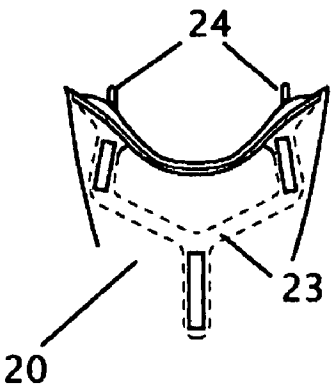
FIGS. 5A–F show plan views of alternate embodiments of a rear panel.
Figure 5B:
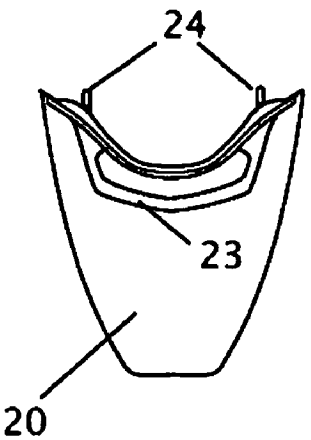
Figure 5A:
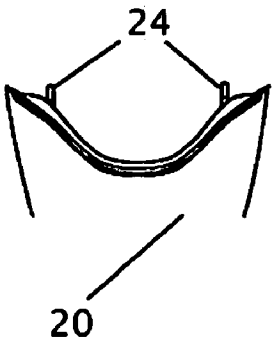

In FIG. 5A, the rear panel 20 has no structural element 23. However, the rear panel 20 can have other structural features, such as areas of its skin that have been reinforced with different material characteristics.

In FIG. 5B, the rear panel 20 has a structural element 23 with a wide, shallow "u" shape that connects to the front edge 21 of the rear panel 20. Since the front edge 21 is connected to the coupling mechanisms 24, force can be transferred between the water, the structural element 23, the front edge 21, and the coupling mechanisms 24. In the illustrated embodiment, the structural element 23 is shown with solid lines, which indicates that it is visible from the top surface of the rear panel 20. This may be because, for example, the element 23 is located on top of, or embedded in, the top surface. In an alternate embodiment (not shown), the structural element 23 is not visible from the top surface of the rear panel 20. This may be because, for example, the element 23 is located inside of the rear panel 20 or is attached to (or embedded in) the bottom surface of the rear panel 20.

In FIG. 5C, the rear panel 20 has a structural element 23 with a "y" shape that connects to the front edge 21 of the rear panel 20. In the illustrated embodiment, the structural element 23 is shown with dashed lines, which indicates that it is not visible from the top surface of the rear panel 20. In an alternate embodiment (not shown), the structural element 23 is visible from the top surface of the rear panel 20. The rectangular areas within the structural element 23 represent places where fins 26 (or fin mounting mechanisms) can be attached.

Figure 5F:
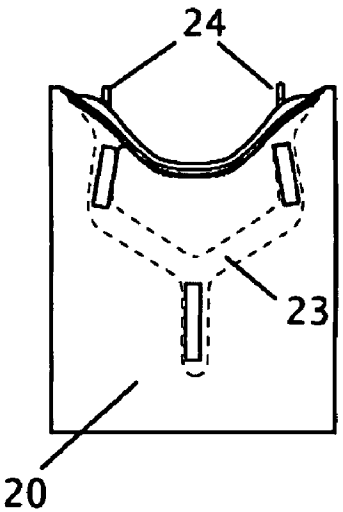
Figure 5E:
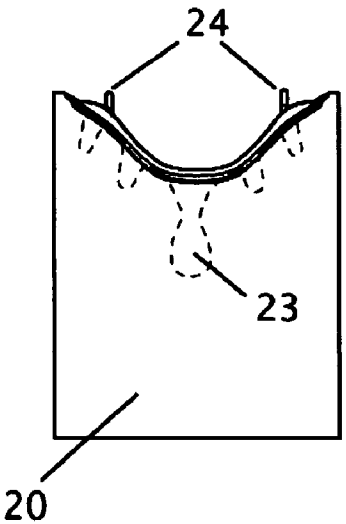
Figure 5D:
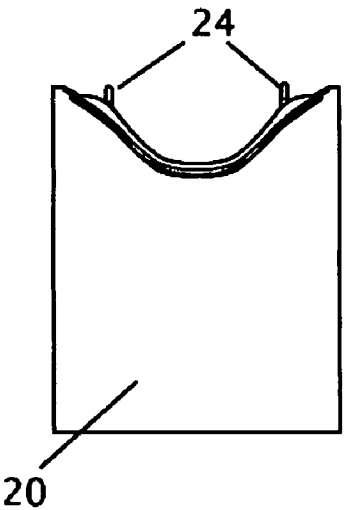

In FIG. 5D, the rear panel 20 has no structural element 23. However, the rear panel 20 can have other structural features, such as areas of its skin that have been reinforced with different material characteristics. Note that the left and right edges of the rear panel 20 in the illustrated embodiment are straight instead of curved. This indicates that the panel 20 has not yet been shaped (e.g., the "panel" is actually an un-shaped blank that has the coupling mechanisms 24 integrated into it during manufacturing).

In FIG. 5E, the rear panel 20 has a structural element 23 that includes a plurality of curves and connects to the front edge 21 of the rear panel 20 in two places. In the illustrated embodiment, the structural element 23 is shown with dashed lines. This indicates that it is not visible from the top surface of the rear panel 20. This may be because, for example, the element 23 is located within (i.e., inside) the rear panel 20. Note also that the structural element 23 has been integrated into an un-shaped block (as indicated by the straight left and right edges of the rear panel 20).

The structural element 23 in FIG. 5F is similar to that shown in FIG. 5C, except that part of the structural element 23 is not visible from the top surface of the rear panel 20. Also, the structural element 23 has been integrated into an un-shaped block (as indicated by the straight left and right edges of the rear panel 20).

FIGS. 5A, 5B, 5C, 5D, 5E, and 5F show only a few embodiments of a rear panel 20. Other types of structural elements 23 can include, for example, rods, beams, and one or more stringers in various configurations, such as a single stringer down the midline, multiple parallel single stringers, one stringer or multiple stringers in a wedge shape, a double T-band stringer, and a triple T-band stringer. In addition, structural elements 23 can differ in terms of shape, size, composition (e.g., material and structure), and location (e.g., relative to the rest of the rear panel 20). While areas for attaching fins 26 (or fin mounting mechanisms) are shown in only FIGS. 5C and 5F, these areas can be located anywhere on a rear panel 20 and may or may not connect to a structural element 23.

Coupling Interface

As mentioned above, a surfboard is created by selecting a front panel 10, selecting a rear panel 20, and coupling them to form a substantially surfboard shape. The coupling is temporary so that the front panel 10 can later be coupled to a different rear panel 20, and/or the rear panel 20 can later be coupled to a different front panel 10, thereby creating different boards with different performance characteristics.

In one embodiment, the coupling is performed by one or more mechanisms 14 in the front panel 10 and one or more mechanisms 24 in the rear panel 20. The mechanisms 14, 24 are designed to couple in a particular way so that they temporarily "lock" together the front panel 10 and the rear panel 20. The phrase "interface" refers to a collection of mechanisms 14, 24 that are designed to be coupled together.

Coupling Mechanism

The coupling mechanisms 14, 24 can vary in terms of shape, size, composition (e.g., material and structure), and location. In one embodiment, a first coupling mechanism comprises a tab or arm, and a second coupling mechanism comprises a slot into which the first coupling mechanism is inserted. The tab or arm would be located on one panel, and the slot would be located on the other panel. For example, the tab or arm can be located on the front panel 10, and the slot can be located on the rear panel 20 (or vice versa). In one embodiment, an interface has two pairs of coupling mechanisms, one on the left half of the board and one on the right half of the board. In another embodiment, an interface has only one pair of coupling mechanisms (e.g., in the middle of the board).

In general, a coupling mechanism 14, 24 is located near the "interface edge" of a panel. For example, the front coupling mechanism 14 is located near the rear edge 12 of the front panel 10, and the rear coupling mechanism 24 is located near the edge 21 of the rear panel 20. However, the exact locations of the coupling mechanisms 14, 24 can vary. In one embodiment, a coupling mechanism 14, 24 is located directly on an interface edge. In another embodiment, a coupling mechanism 14, 24 is located on the surface (top or bottom) of a panel, near the interface edge. In yet another embodiment, a coupling mechanism 14, 24 is located within a panel. In yet another embodiment, a coupling mechanism 14, 24 is located on a structure that extends from the panel past the interface edge (e.g., on a variable flex interface 30, which will be discussed below). Also, a coupling mechanism 14, 24 can be connected to a structural element 13, 23, a fin 16, 26, and/or a fin cassette 17, 27.

The front and back interface edges 12, 21 should fit together, but they can be of any substantially complementary shapes. In one embodiment, they are linear and run perpendicular to the midlines of the panels 10, 20. In another embodiment, they are non-linear. Non-linear interface edges 12, 21 are beneficial because they act to automatically align the panels 10, 20 (and therefore the coupling mechanisms 14, 24) so that they are positioned correctly for coupling.

A coupling mechanism 14, 24 located within a panel would probably be incorporated during manufacturing, while a coupling mechanism 14, 24 located on the surface of a panel can be implemented as an attachment to a blank (e.g., by laminating it) or as an integrated part of a foam blank (e.g., by injection molding). A coupling mechanism 14, 24 can be made of any material, such as wood (e.g., cedar, spruce, balsa, or redwood), plastic, fiberglass, or metal.

Once the panels have been coupled, they need some type of lock or latch to keep them together. In one embodiment, positive snap locks are used and can be depressed to unlock the two panels. In another embodiment, flexible elastomeric parts with "tab" keyed or shaped heads (e.g., plastic or rubber) fit or snap into "slot" shapes. This embodiment provides benefits related to flex and absorption of vibration, due to the elastomeric parts. Other possible methods include, for example, magnetic locks, latchings, cam-over latchings, ratchet-type connections, and eccentric rotation locking knobs. The "locking action" of a pair of coupling mechanisms can have any direction. For example, it can be directed toward the front panel 10 or the rear panel 20 (or both).

Figure 6B:
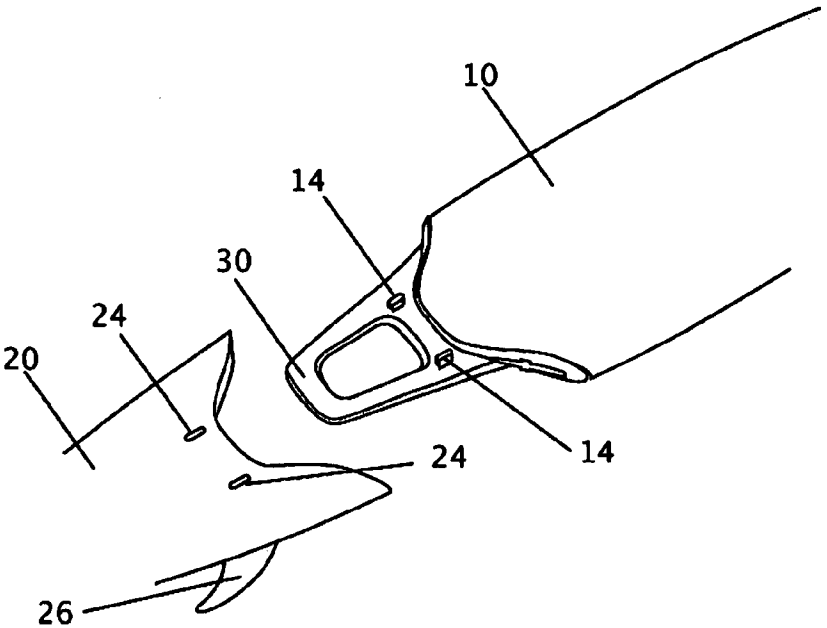
FIGS. 6A–H show perspective views of alternate embodiments of coupling mechanisms.
Figure 6A:
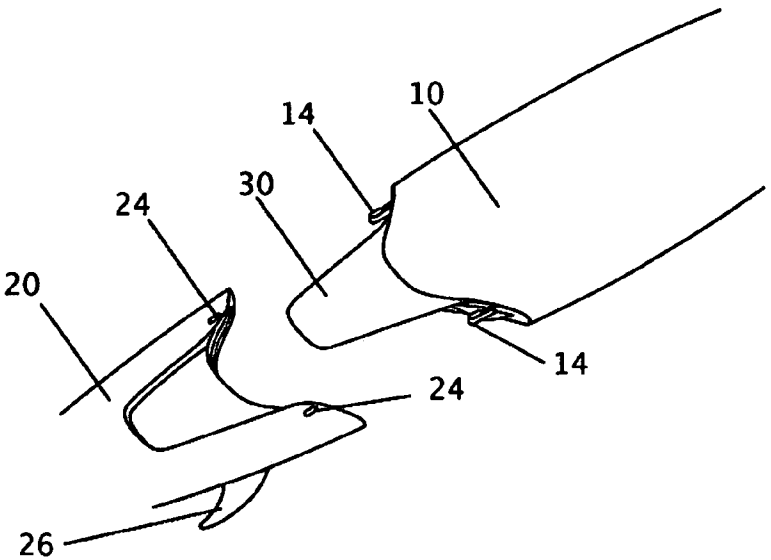

FIGS. 6A–H show perspective views of alternate embodiments of coupling mechanisms. In these figures, the front edge 11 of the front panel 10 and the rear edge 22 of the rear panel 20 are not shown, since their shapes can vary, as discussed above. In FIG. 6A, the coupling mechanisms 14 of the front panel 10 comprise arms that are located on the front interface edge 12 and extend rearward toward the rear interface edge 21. These arms insert into the coupling mechanisms 24 of the rear panel 20, which are slots.

Figures 6C, 6D, 6E:
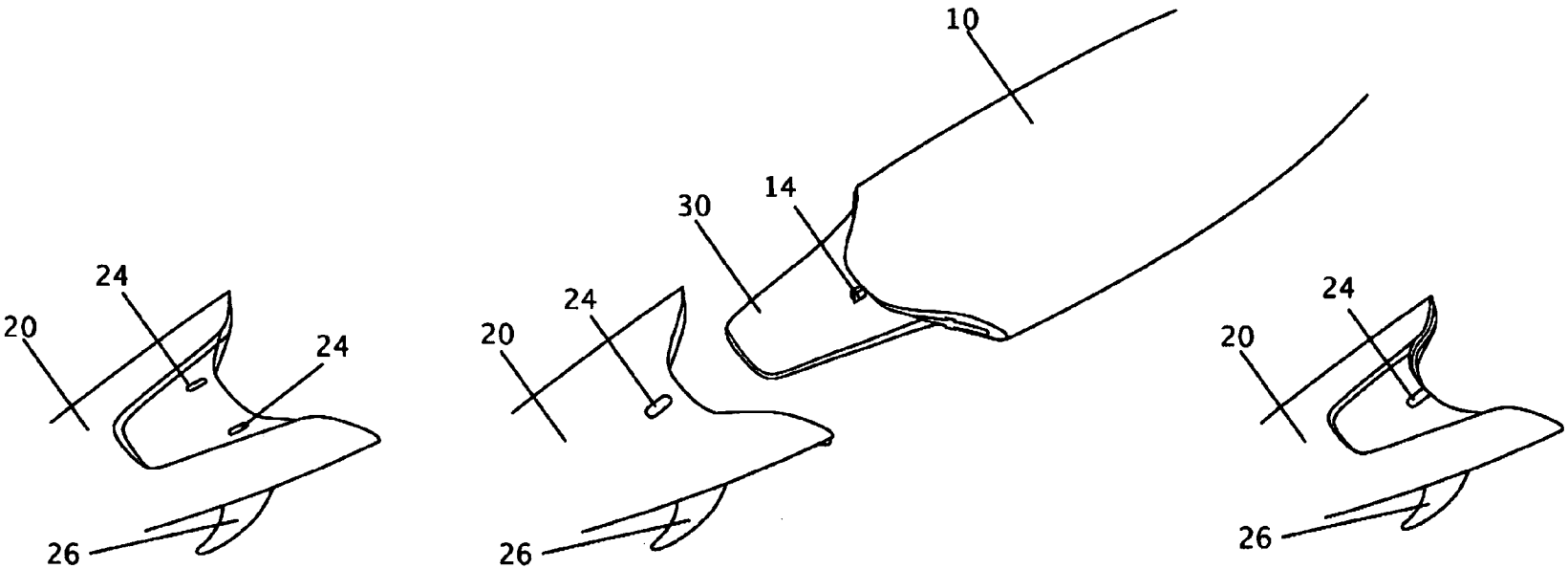

In FIG. 6B, the coupling mechanisms 14 of the front panel 10 comprise tabs that are located on a variable flex interface 30 (a structure that extends rearward from the front panel 10 past the interface edge 12 toward the rear interface edge 21). These tabs insert into the coupling mechanisms 24 of the rear panel 20, which are slots. In the illustrated embodiment, the slots are located in a cassette in the rear panel 20. FIG. 6C shows an alternate rear panel 20 that can connect to the front panel 10 shown in FIG. 6B. This alternate rear panel 20 also has slots, but here the slots are located on an indented surface of the rear panel 20.

In FIG. 6D, the coupling mechanism 14 of the front panel 10 comprises a tab that is located on a variable flex interface 30. This tab inserts into the coupling mechanism 24 of the rear panel 20, which is a slot. In the illustrated embodiment, the slot is located in a cassette in the rear panel 20. FIG. 6E shows an alternate rear panel 20 that can connect to the front panel 10 shown in FIG. 6D. This alternate rear panel 20 also has a slot, but here the slot is located on an indented surface of the rear panel 20.

Figure 6F:
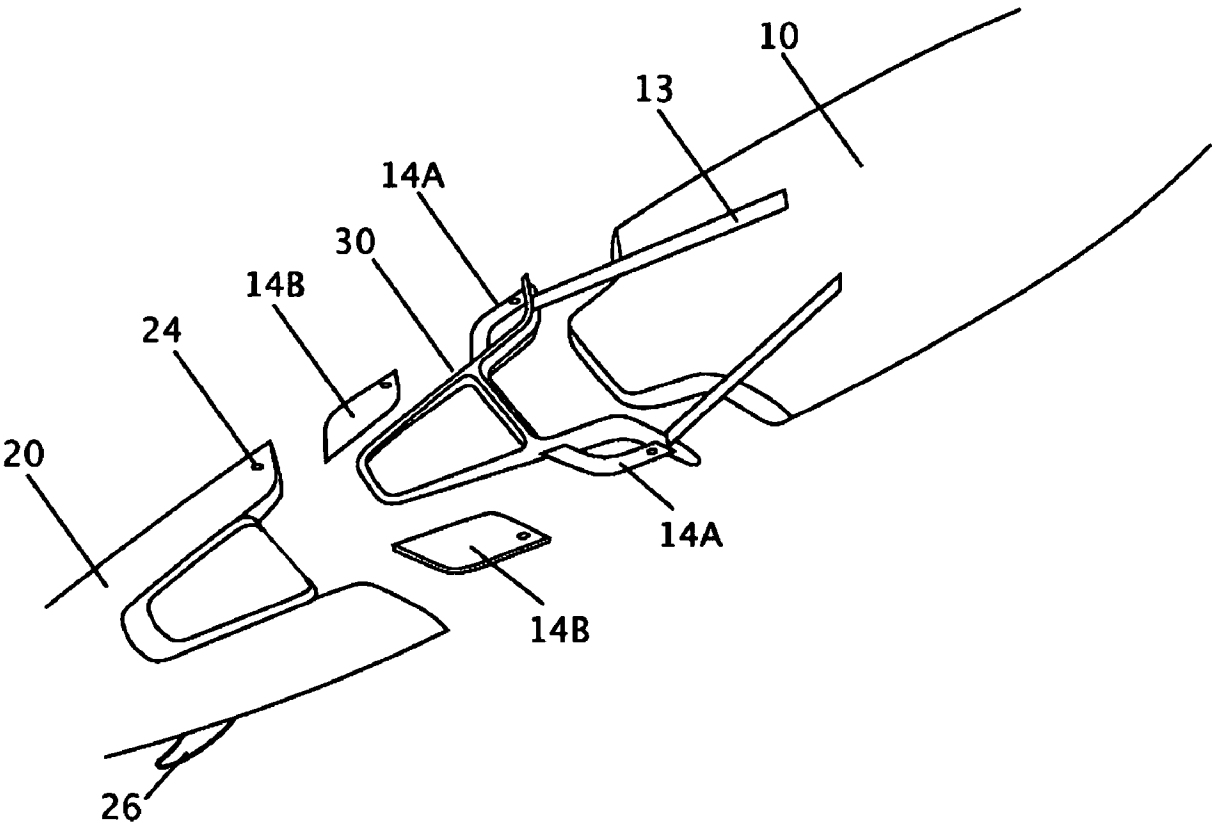

In FIG. 6F, the coupling mechanisms 14A of the front panel 10 comprise shaped beam members that are located on the front interface edge 12 and extend rearward toward the rear interface edge 21. These beams insert into the coupling mechanisms 24 of the rear panel 20, which are slots. In the illustrated embodiment, the slots are located in a cassette in the rear panel 20. FIG. 6F also shows alternate coupling mechanisms 14B of the front panel 10, which comprise shaped tabs that are located on the front interface edge 12 and extend rearward toward the rear interface edge 21. These tabs insert into the coupling mechanisms 24 of the rear panel 20, which are slots. In the illustrated embodiment, the front coupling mechanisms 14 are connected to structural elements 13 and to a variable flex interface 30.

Figure 6G:
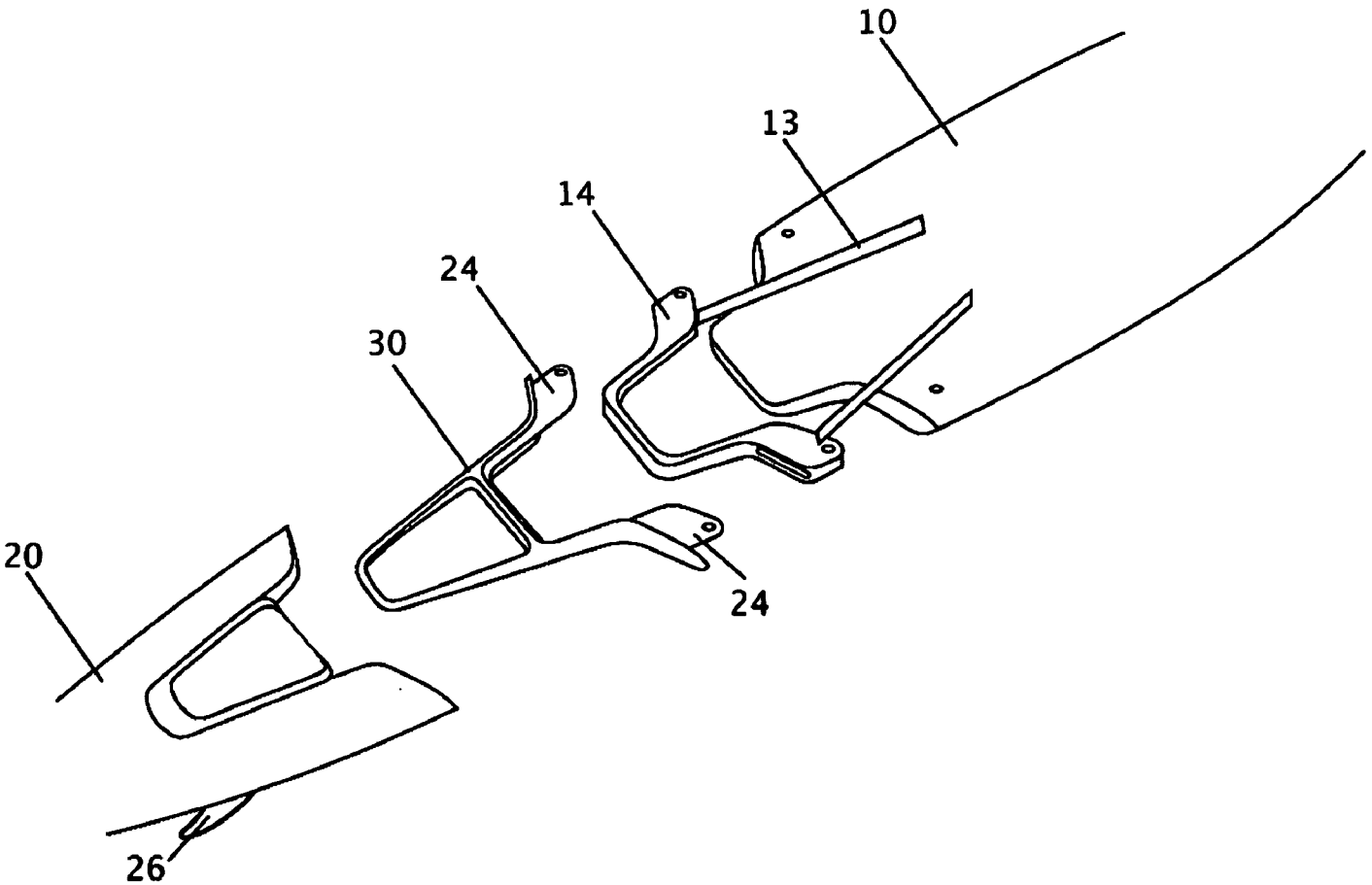

In FIG. 6G, the coupling mechanisms 24 of the rear panel 20 comprise shaped tab members that are located on the back interface edge 21 and extend forward toward the front interface edge 12. These tabs insert into the coupling mechanisms 14 of the front panel 10, which are slots. In the illustrated embodiment, the slots are located in a cassette in the front panel 10. In the illustrated embodiment, the rear coupling mechanisms 24 are connected to a variable flex interface 30, and the front coupling mechanisms 14 are connected to structural elements 13.

Figure 6H:
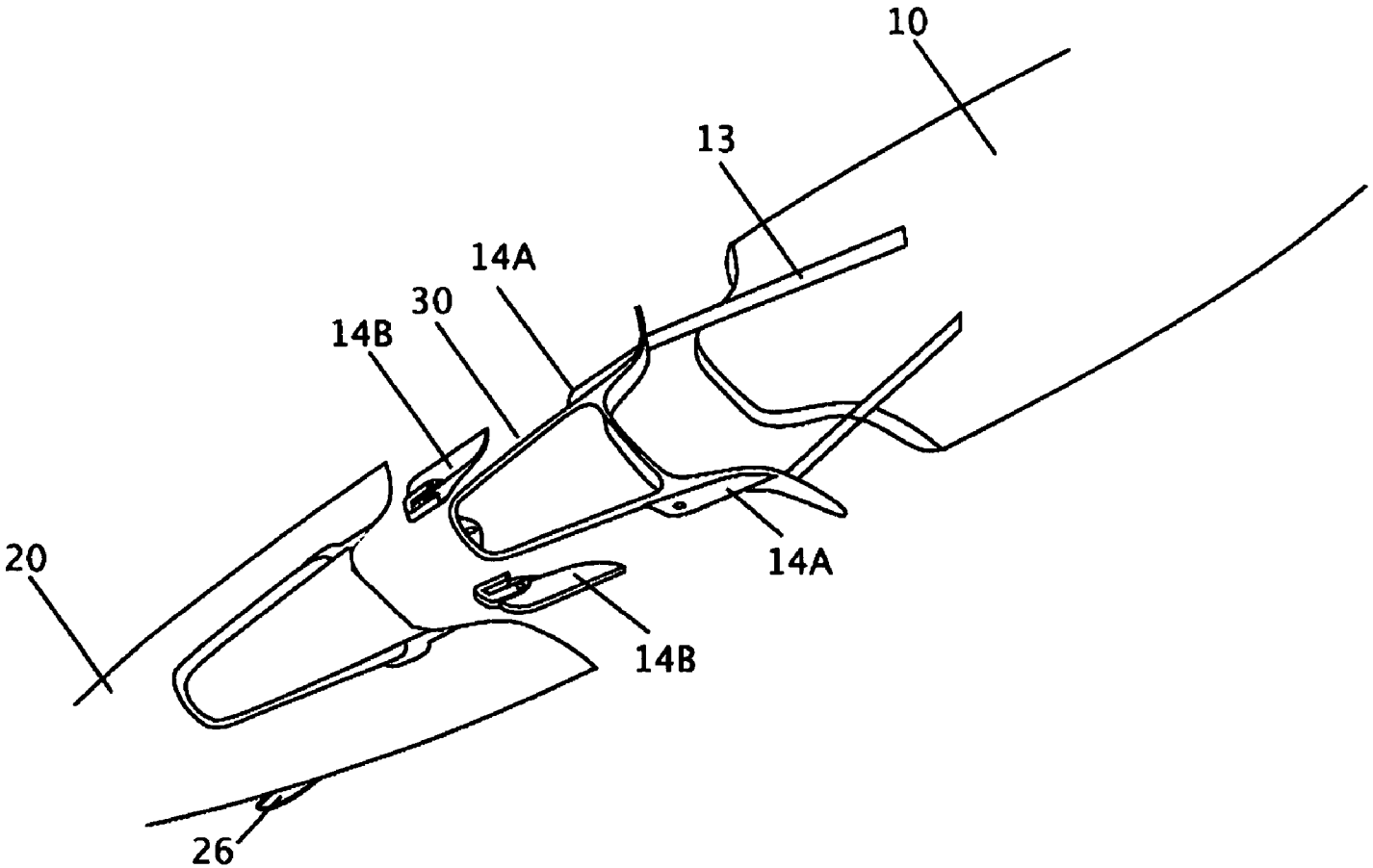

In FIG. 6H, the coupling mechanisms 14A of the front panel 10 comprise shaped wing members that are located on the front interface edge 12 and extend rearward toward the rear interface edge 21. These wings insert into the coupling mechanisms 24 of the rear panel 20, which are slots. In the illustrated embodiment, the slots are located in a cassette in the rear panel 20. FIG. 6H also shows alternate coupling mechanisms 14B of the front panel 10, which comprise different shaped wing members that are located on the front interface edge 12 and extend rearward toward the rear interface edge 21. These wings insert into the coupling mechanisms 24 of the rear panel 20, which are slots. In the illustrated embodiment, the front coupling mechanisms 14 are connected to structural elements 13 and to a variable flex interface 30.

FIGS. 6A, 6B 6C, 6D, 6E, 6F, 6G, and 6H show only a few embodiments of interfaces and coupling mechanisms 14, 24. Other types of interfaces and coupling mechanisms 14, 24 are possible.

Adaptor

While front panels 10 and rear panels 20 can have different shapes, sizes, and/or compositions, they still need to fit together. In order for this to happen, their interface edges 12, 21 should match. In other words, the panels 10, 20 should have similar (or identical) cross sections where they come together. This requirement restricts which front panels 10 can be coupled to which rear panels 20 and, as a result, limits the types of boards that can be created using the system.

In one embodiment, rather than directly coupling a front panel 10 and a rear panel 20, an adaptor 40 is used. The adaptor 40 acts as a third panel that couples to both the front panel 10 and the rear panel 20, thereby forming a substantially surfboard shape. The adaptor 40 includes one or more coupling mechanisms 44 near its front edge 41 (which connect to the coupling mechanisms 14 of the front panel 10) and one or more coupling mechanisms 44 near its rear edge 42 (which connect to the coupling mechanisms 24 of the rear panel 20).

Since an adaptor 40 has two "interface edges," it can accommodate a front panel 10 and a rear panel 20 whose cross sections differ. This enables more panel combinations and, ultimately, more types of surfboards. An adaptor 40 also enables the shape and form of a board to transition over a greater distance, tapering from the front panel 10 shape to the rear panel 20 shape.

Figure 7A:
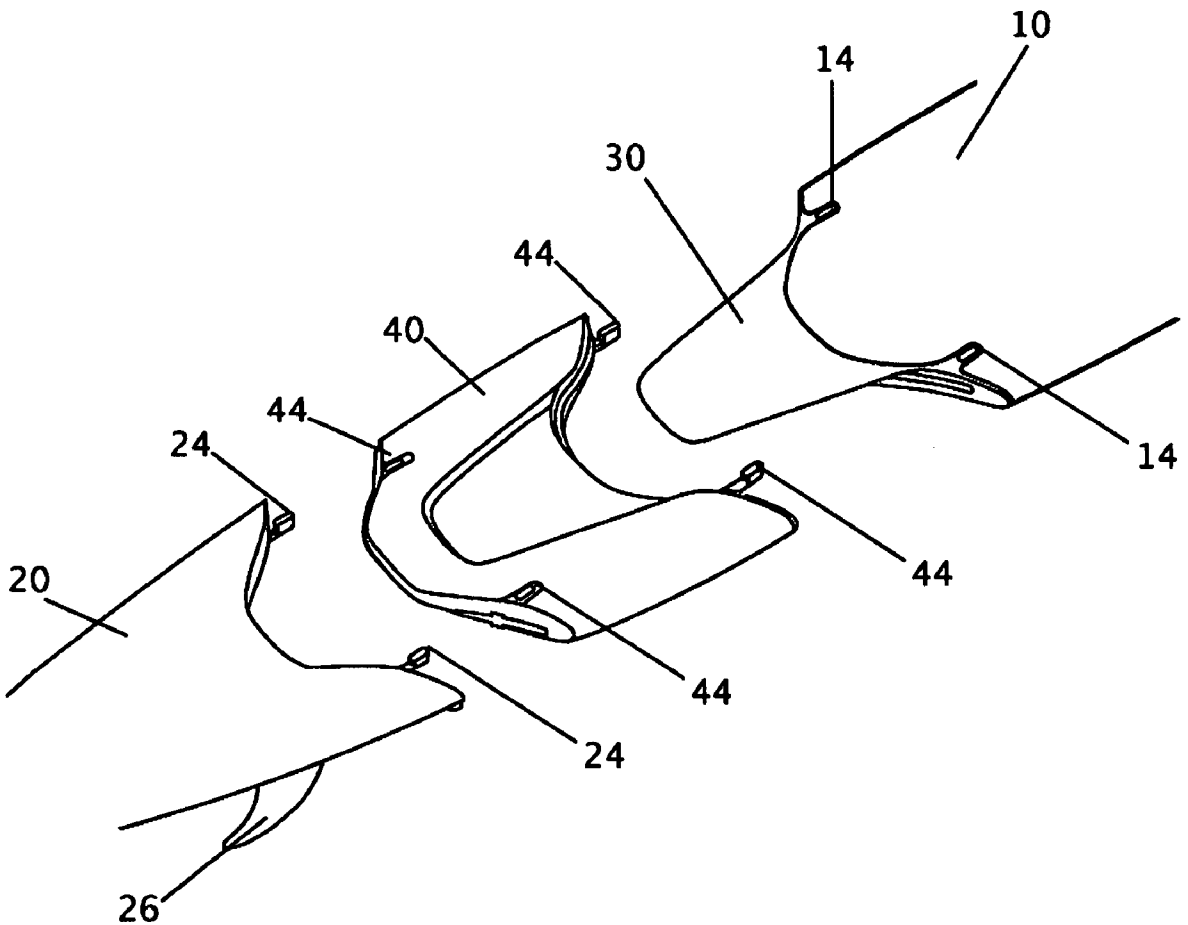
FIGS. 7A, 7B, and 7C show perspective views of alternate embodiments of adaptors.
Figure 7B:
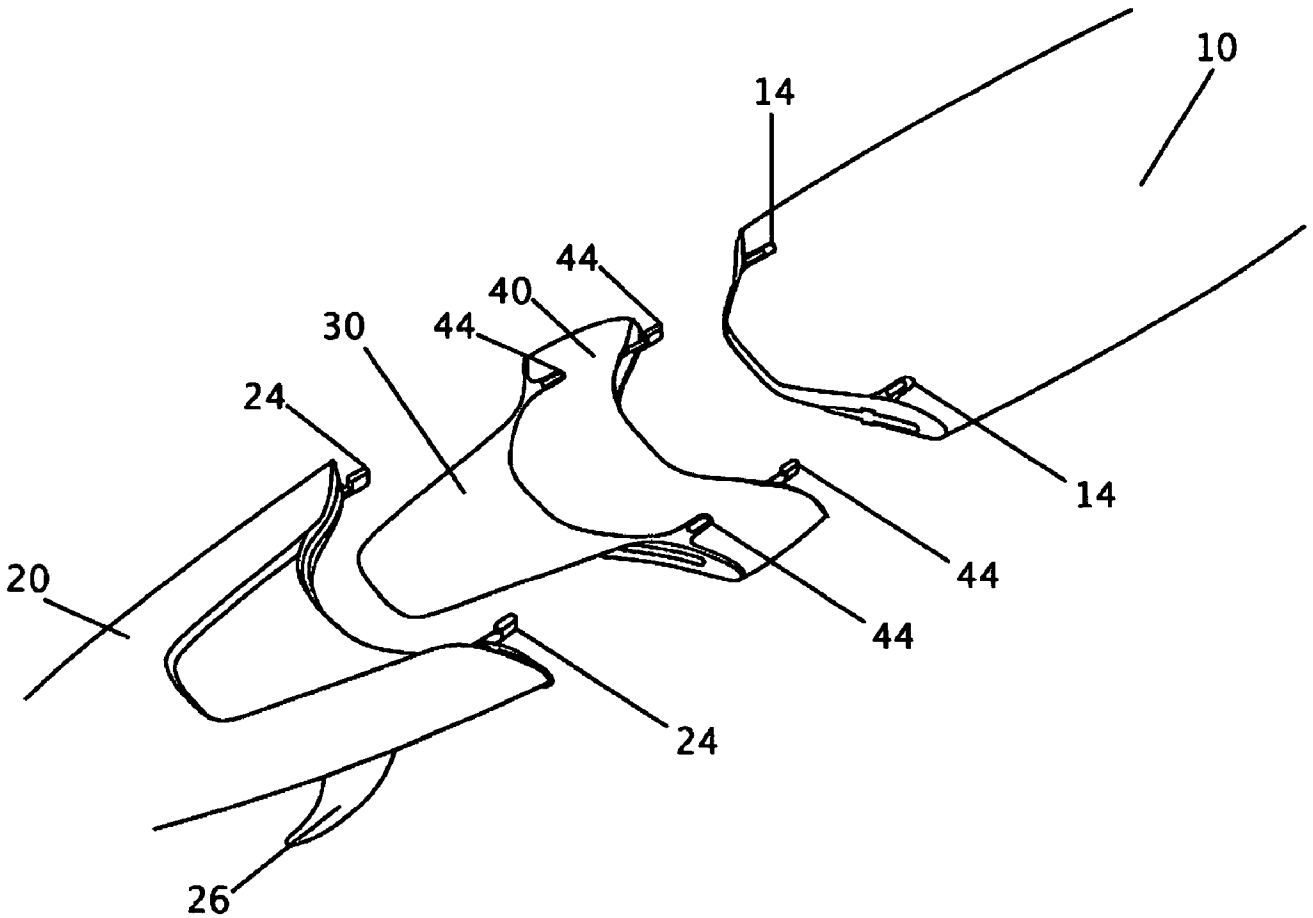
Figure 7C:
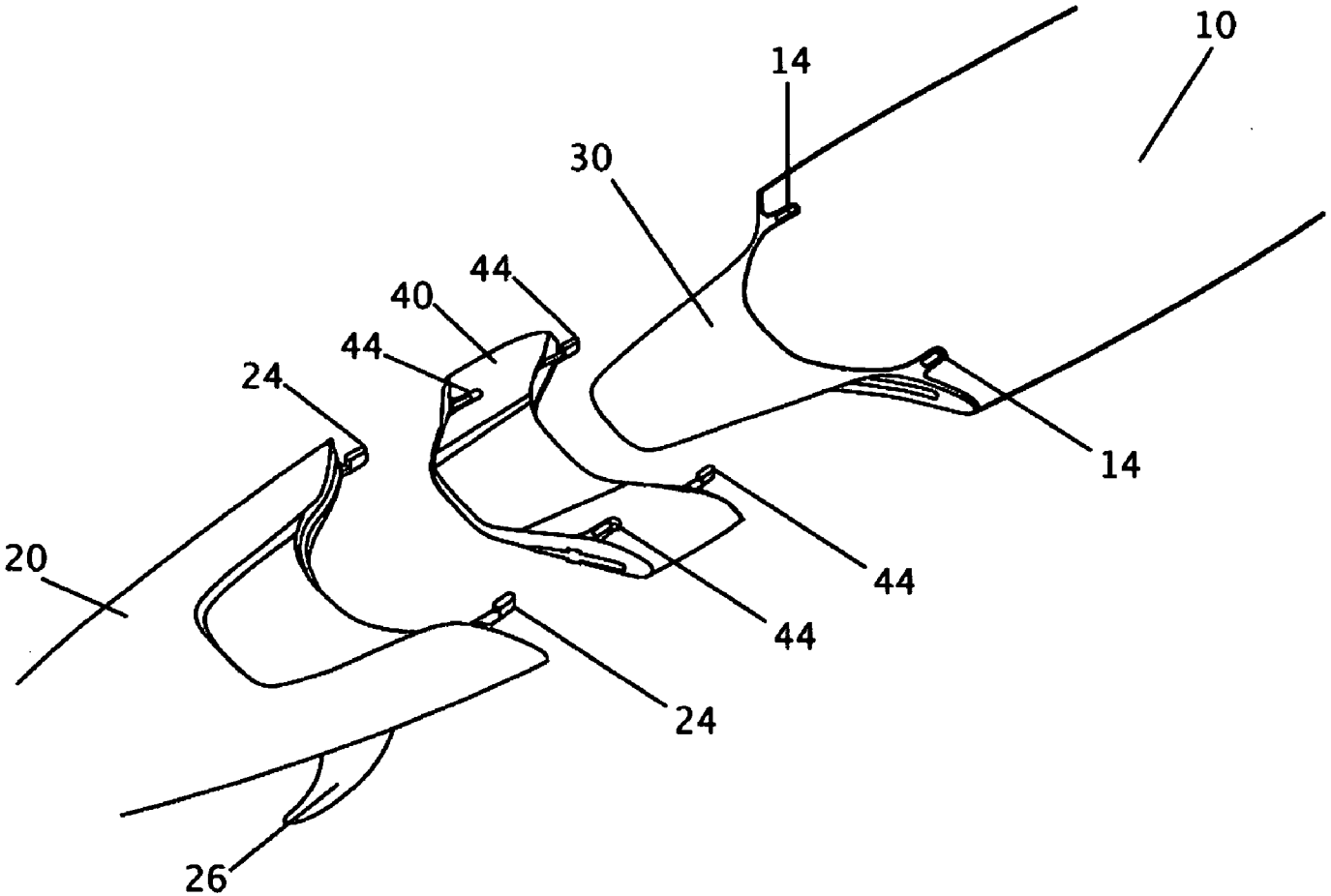

FIGS. 7A, 7B, and 7C show perspective views of alternate embodiments of adaptors. In these figures, the front edge 11 of the front panel 10 and the rear edge 22 of the rear panel 20 are not shown, since their shapes can vary, as discussed above.

The adaptors shown in these figures accommodate variable flex interfaces 30 in different ways. In FIG. 7A, the variable flex interface 30 extends from the front panel 10 past its interface edge 12 toward the adaptor 40, which receives the entire variable flex interface 30. ("Receipt" of a variable flex interface 40 will be discussed below.) In FIG. 7B, the variable flex interface 30 extends from the adaptor 40 past its rear interface edge 42 toward the rear panel 20, which receives the entire variable flex interface 30. In FIG. 7C, the variable flex interface 30 extends from the front panel 10 past its interface edge 12 toward the adaptor 40. Here, the variable flex interface 30 is longer than the adaptor 40, so the adaptor receives some of the variable flex interface 30, and the rear panel 20 receives the rest.

Variable Flex Interface

In one embodiment, a surfboard's performance characteristics are enhanced by including a variable flex interface 30. A variable flex interface (VFI) 30 is a flexible structure, similar to a miniature diving board, that is coupled to a panel 10, 20 or adaptor 40 (the "VFI panel") and extends beyond an edge of that panel. The end of the VFI 30 that is coupled is called the "anchor," while the opposite end (which is usually free-floating) is called the "extension."

Figure 16A:
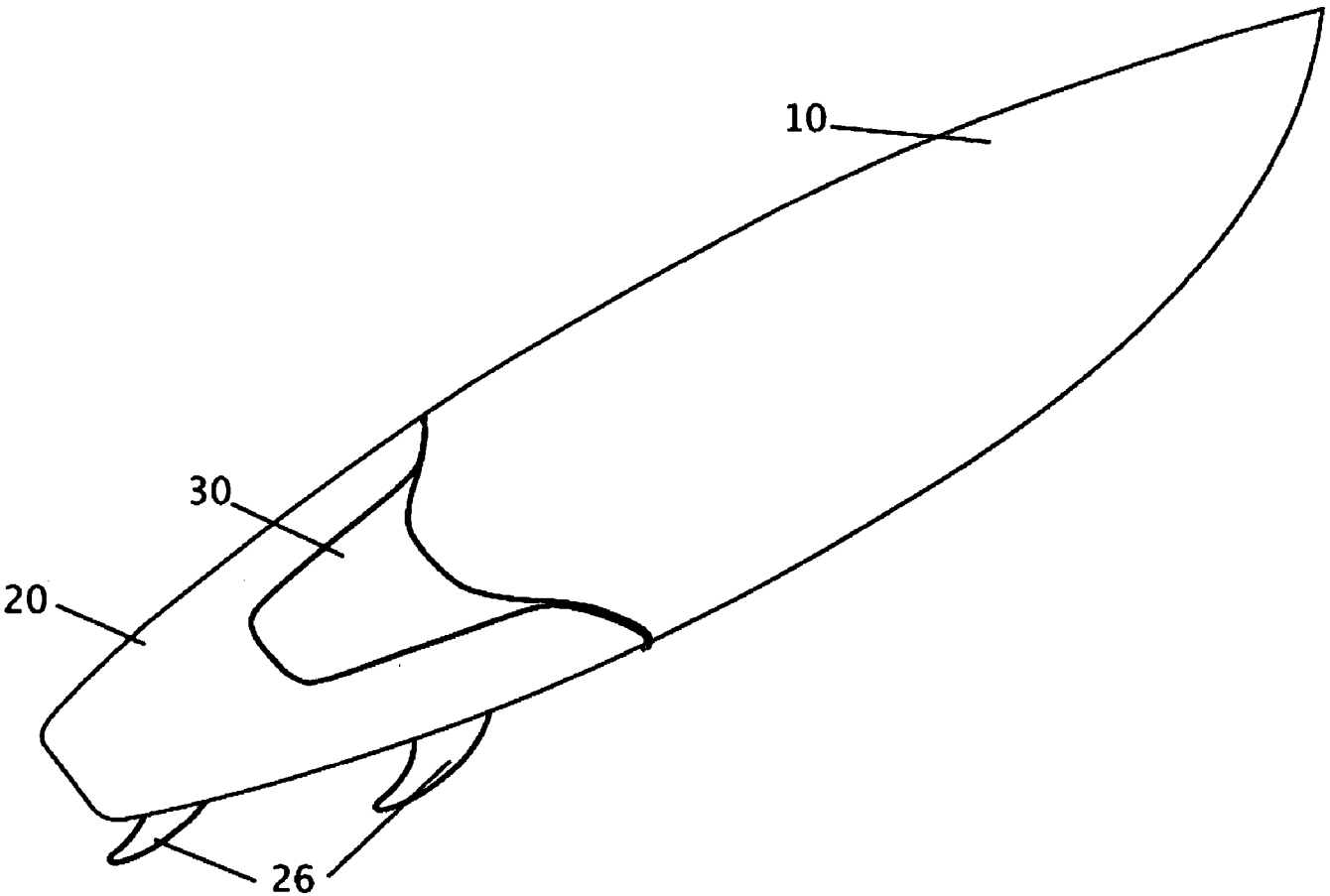
FIG. 16A shows a perspective view of a surfboard that includes a variable flex interface.
Figure 16B:
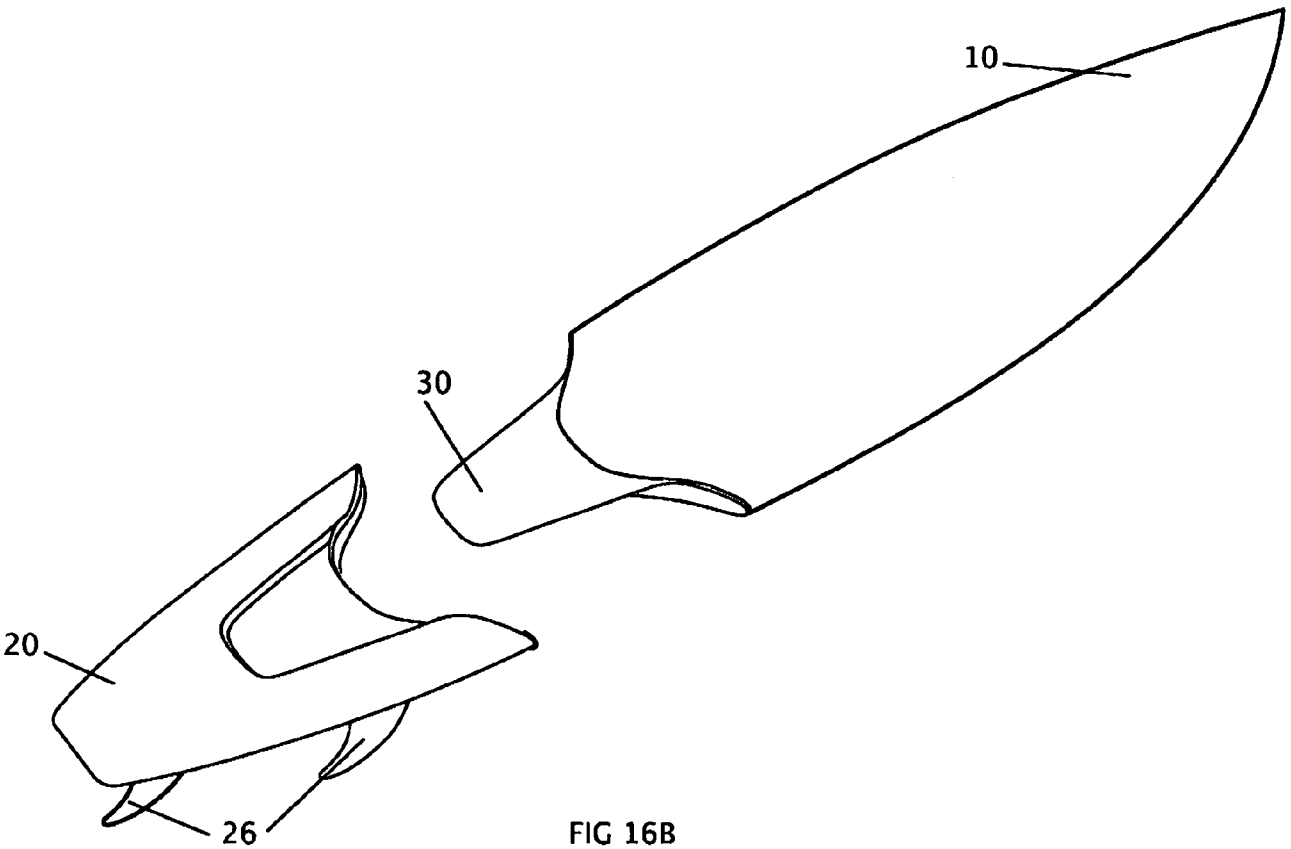
FIG. 16B shows an exploded perspective view of the surfboard shown in FIG. 16A.

FIG. 16A shows a perspective view of a surfboard that includes a variable flex interface. FIG. 16B shows an exploded perspective view of the surfboard shown in FIG. 16A. In this view, the front panel 10 has been decoupled from the rear panel 20. In the illustrated embodiments, the variable flex interface 30 is coupled to the front panel 10 and extends beyond the panel's rear edge 12. Thus, in these embodiments, the front panel 10 is the VFI panel. When the VFI panel is coupled to another panel 10, 20 or adaptor 40 (as in FIG. 16A), the extension end of the VFI 30 is located over, under, or inside that other panel (the "receiving panel"). In FIGS. 16A and 16B, the rear panel 20 is the receiving panel.

Figure 17A:
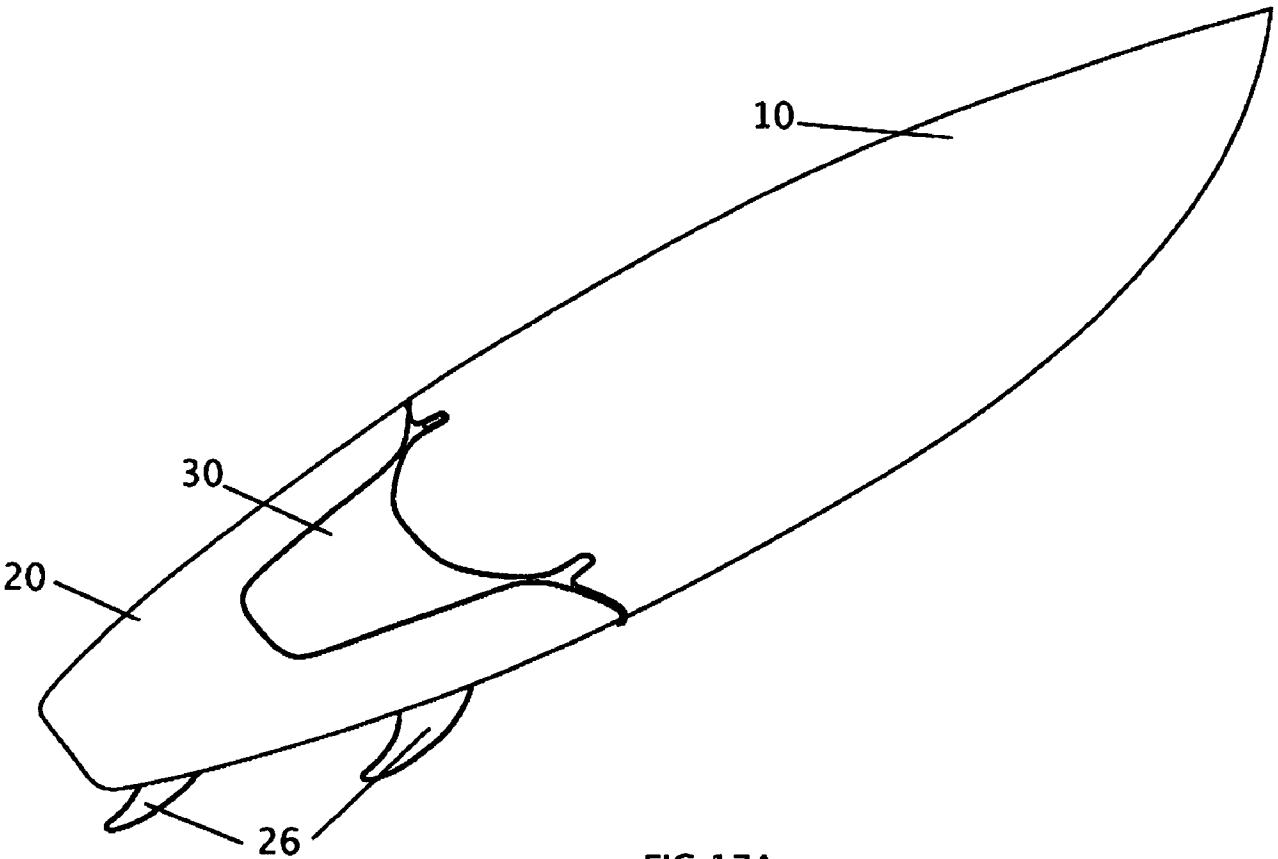
FIG. 17A shows a perspective view of a surfboard that includes coupling mechanisms and a variable flex interface.
Figure 17B:
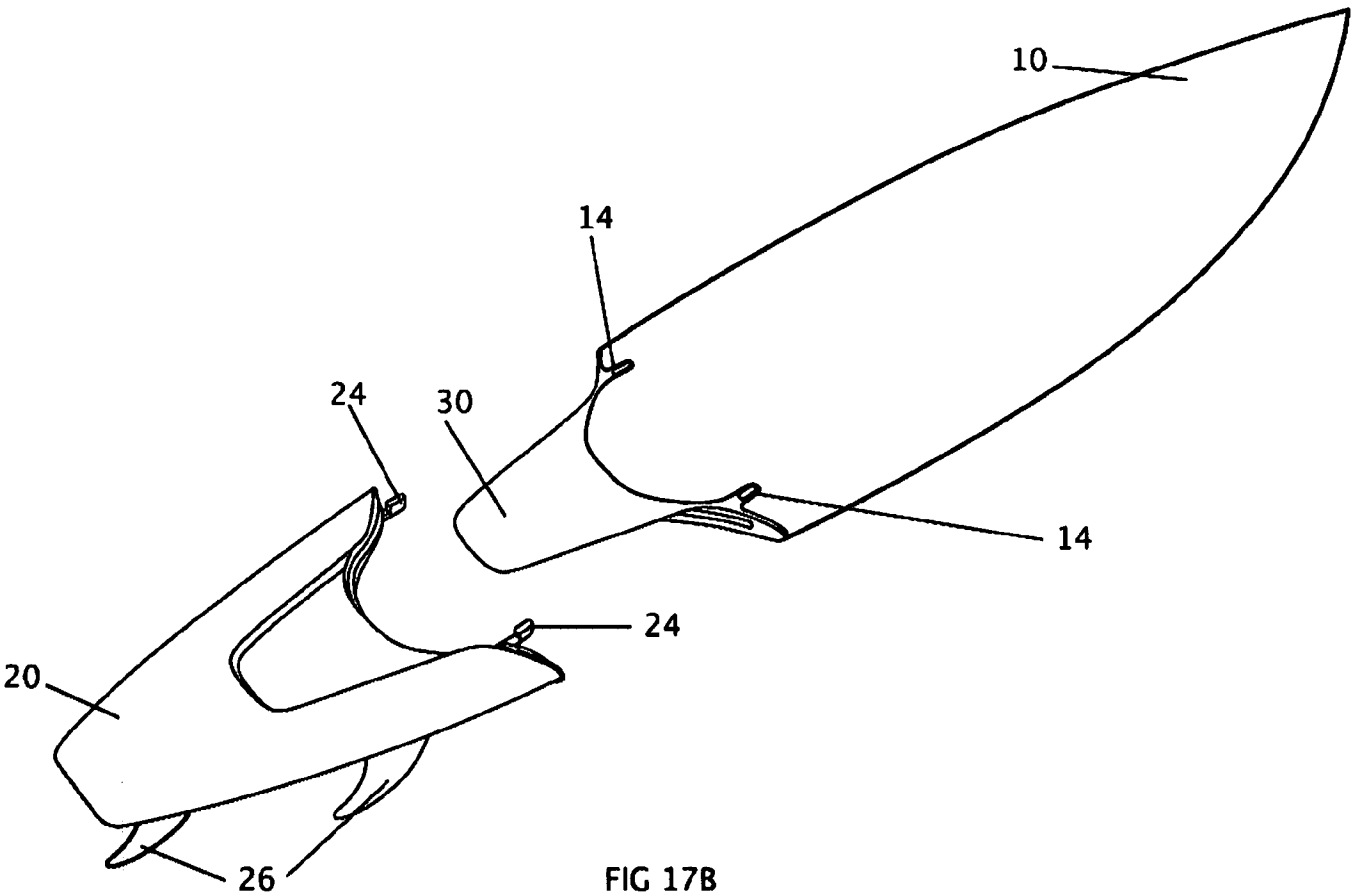
FIG. 17B shows an exploded perspective view of the surfboard shown in FIG. 17A.

Coupling mechanisms 14, 24 have been omitted from FIGS. 16A and 16B so that the variable flex interface 30 can be more clearly identified. FIG. 17A shows a perspective view of a surfboard that includes coupling mechanisms and a variable flex interface. FIG. 17B shows an exploded perspective view of the surfboard shown in FIG. 17A. In this view, the front panel 10 has been decoupled from the rear panel 20.

Recall that a board's shape affects its performance characteristics. For example, a board's rocker curve affects force transfer for turning and other performance aspects. Some degree of flexibility is therefore desirable in a board, since it affects the board's shape and, as a result, its performance characteristics. The VFI 30 creates flex between the VFI panel and the receiving panel and enables a rider to control the amount of this flex. In one embodiment, a rider "engages" the VFI 30 by placing his body on the board such that his weight presses downwards on the VFI 30, thereby bending it and flexing the board. By varying his body position, he can engage the VFI 30 in different amounts. For example, a rider can use his foot to create a vertical pumping movement over the VFI 30. Engaging the VFI 30 can increase the board's response and improve its performance. For example, it can give more force and enable "snappier" turns. It can also enable a rider to get more air. In one embodiment, a rider can interact directly with the VFI 30 by placing one foot (or both) on or near the area where the VFI 30 is located.

Since the VFI 30 can flex during operation of the board, it is generally not coupled to the receiving panel. (Note, however, the VFI coupling mechanism embodiments described below, which are exceptions.) While the VFI 30 may not be coupled to the receiving panel, it sometimes comes in contact with it. The VFI 30 (specifically, its extension end) can interact with the receiving panel in various ways. FIGS. 8A–E show plan views and sectional views of alternate embodiments of a variable flex interface. In these figures, the VFI panel is the front panel 10, and the receiving panel is the rear panel 20. The front edge 11 of the front panel 10 and the rear edge 22 of the rear panel 20 are not shown, since their shapes can vary, as discussed above.

Figure 8C:
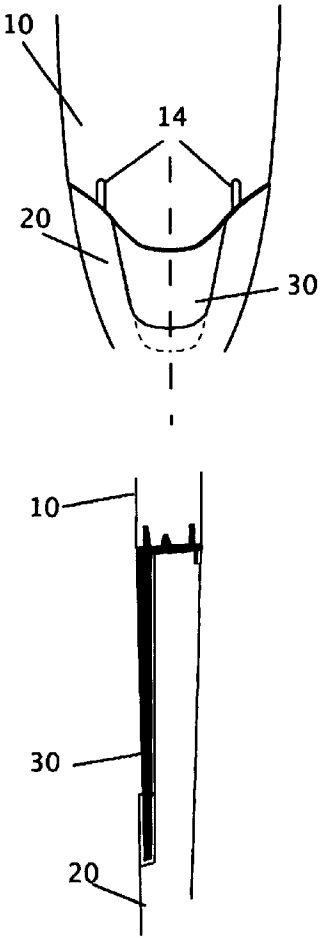
FIGS. 8A–E show plan views and sectional views of alternate embodiments of a variable flex interface.
Figure 8B:
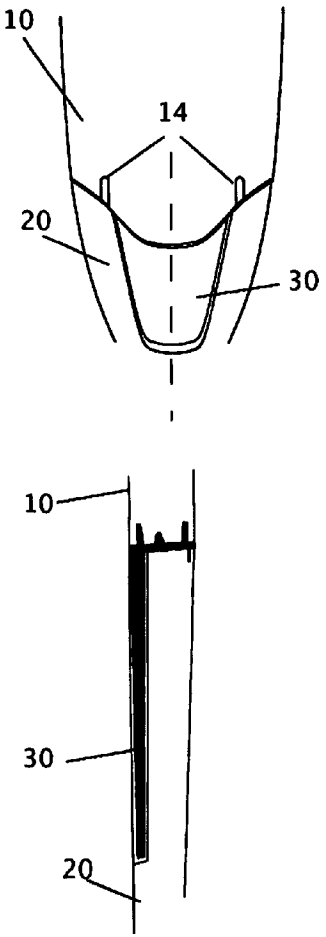
Figure 8A:
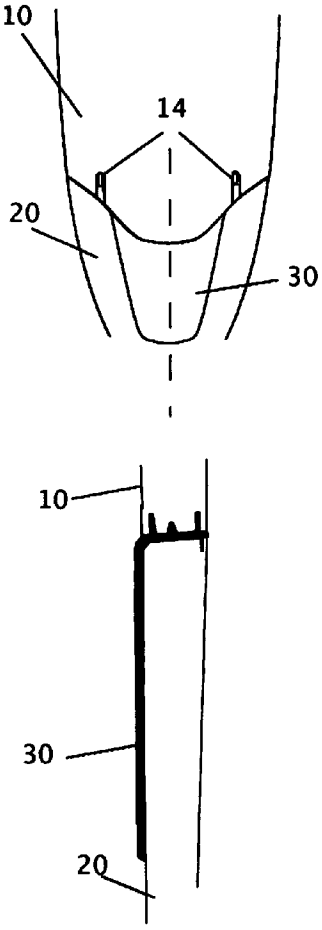
Figure 8E:
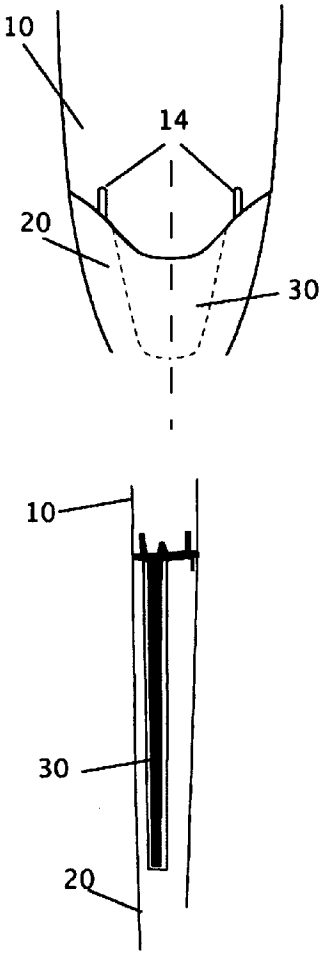
Figure 8D:
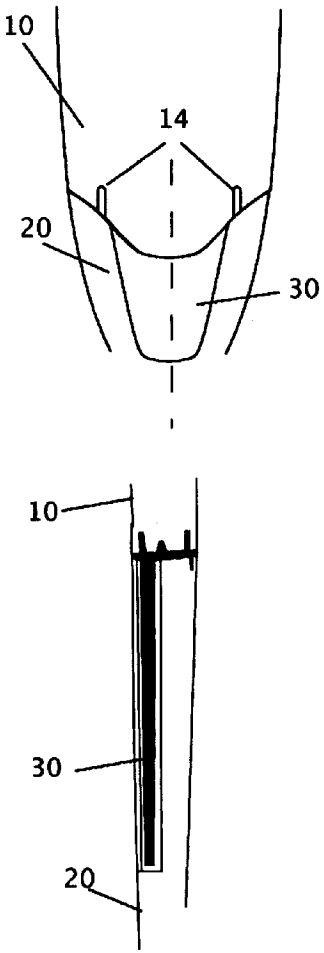

In one embodiment, the extension is located on top of the receiving panel's top surface, as shown in FIG. 8A. In another embodiment, the receiving panel has an open cavity (such as an indented area) in which the VFI 30 rests, as shown in FIG. 8B. In yet another embodiment, the receiving panel can have an enclosed cavity (e.g., inside the receiving panel) into which the VFI 30 can be inserted (not shown). In yet another embodiment, the receiving panel includes a cassette that receives the VFI 30. The cassette can be located, for example, completely inside the receiving panel (e.g., so that it is invisible when looking at the receiving panel; see FIG. 8E), partially inside the receiving panel (e.g., so that one of its edges is flush with the receiving panel's top edge; see FIG. 8D), or completely outside the receiving panel (e.g., on top of the receiving panel's top surface; not shown). In yet another embodiment, the cassette is only partially closed, as shown in FIG. 8C.

The VFI 30 can be attached to the VFI panel in various ways. In one embodiment, the VFI 30 (specifically, its anchor end) is mounted (e.g., laminated) on the VFI panel's top surface. In another embodiment, the anchor is integrated into the VFI panel (e.g., during manufacturing). The anchor can also connect to a structural element or a fin in the VFI panel. The attachment between the VFI 30 and the VFI panel may or may not be permanent. In one embodiment, a temporary attachment enables the VFI 30 to be placed in different positions, thereby varying the distance by which the VFI 30 extends beyond the VFI panel. In another embodiment, a temporary attachment enables the VFI 30 to be completely removed (perhaps to be replaced with a different VFI 30 with different performance characteristics).

In one embodiment, the VFI 30 extends across an adaptor 40 before it reaches the receiving panel, as shown in FIG. 7C. In another embodiment, the VFI 30 extends through an adaptor 40 before it reaches the receiving panel (not shown).

The VFI 30 itself can vary in terms of shape, size, and composition (e.g., material and structure). For example, the VFI 30 can include one or more parts, one of which might be a beam (linear or unshaped). The VFI 30 can also include one or more cavities, which can reduce weight and affect flex characteristics. Also, the VFI 30 can vary in length. In one embodiment, the surface of the VFI 30 includes one or more convex or concave surfaces, such as ribs, to reinforce its structure or to form escape channels for water or particles of sand or dirt.

Figure 9A:
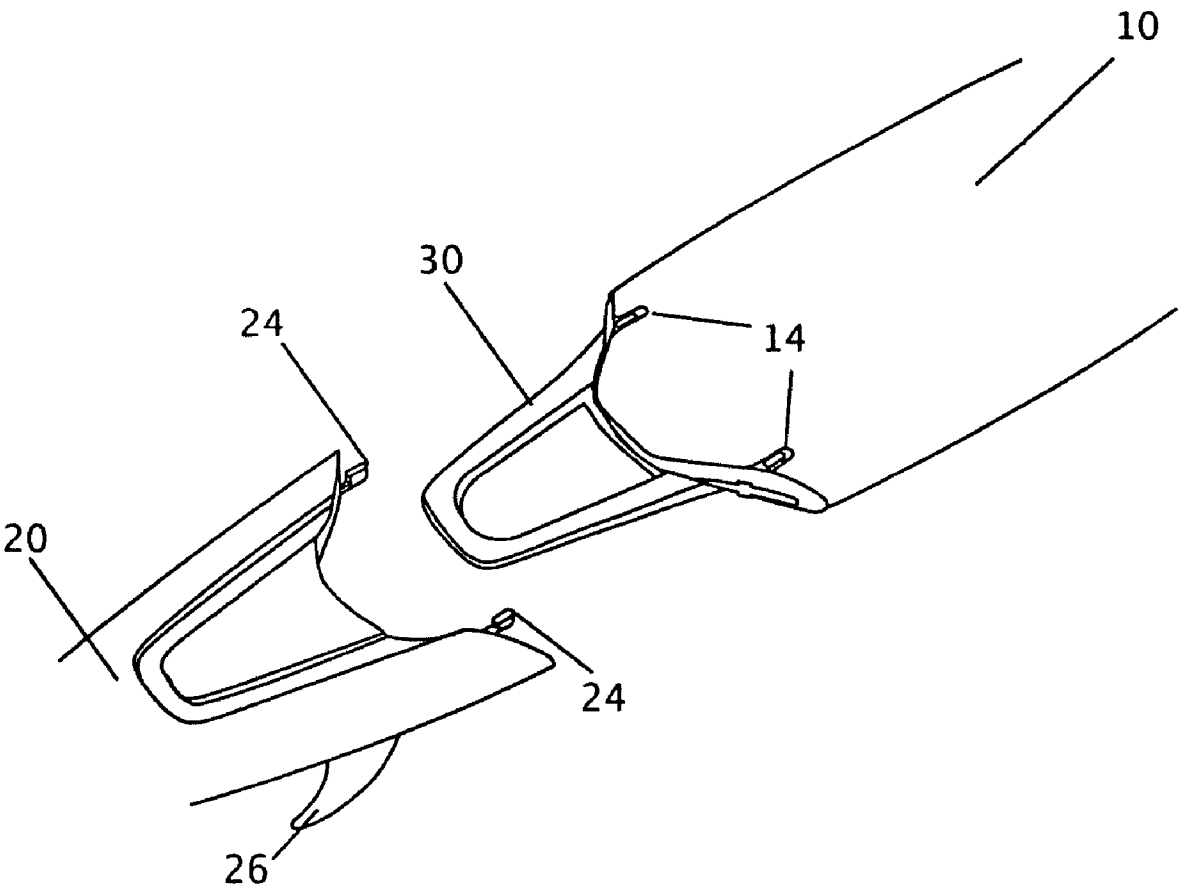
FIGS. 9A, 9B, and 9C show perspective views of alternate embodiments of a variable flex interface.
Figure 9B:
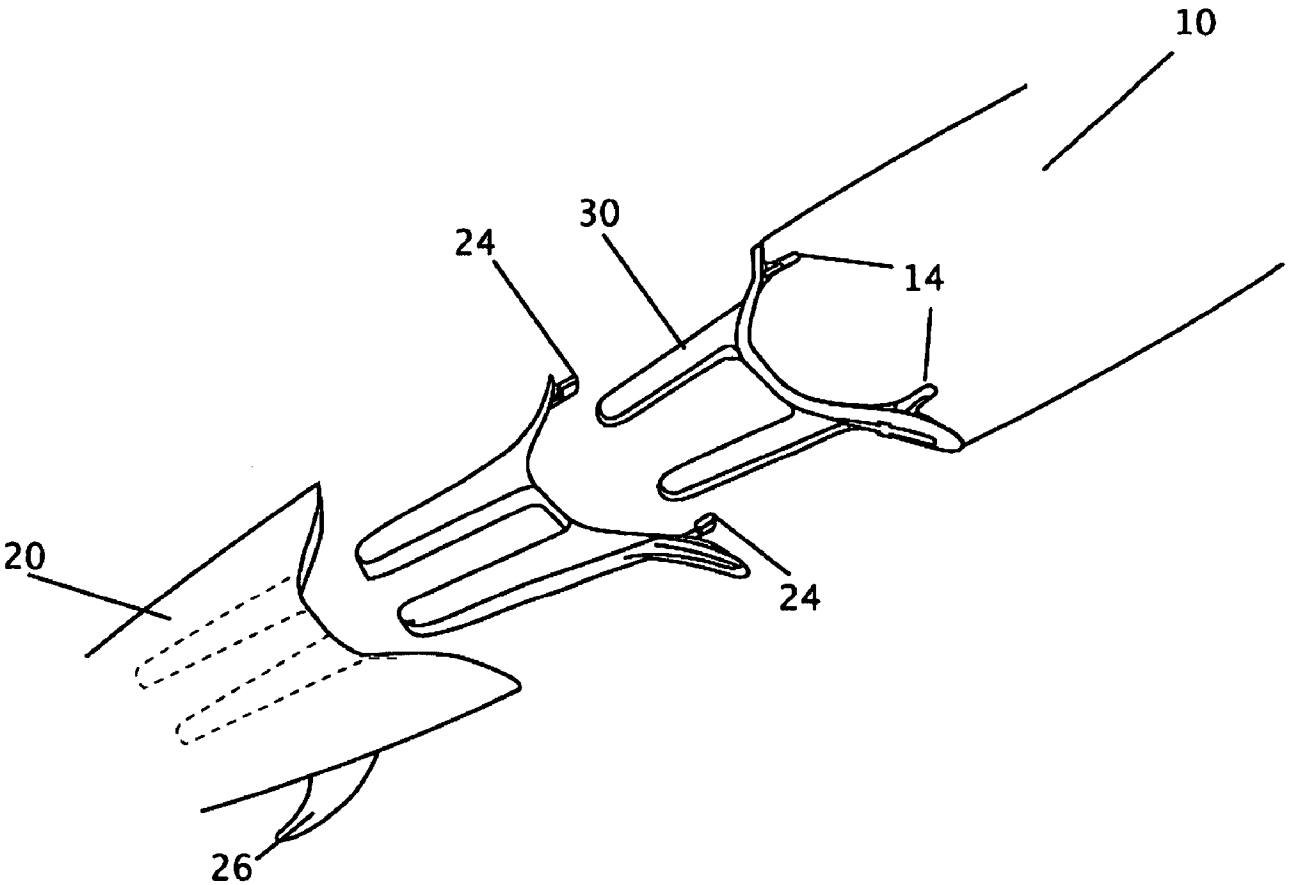
Figure 9C:
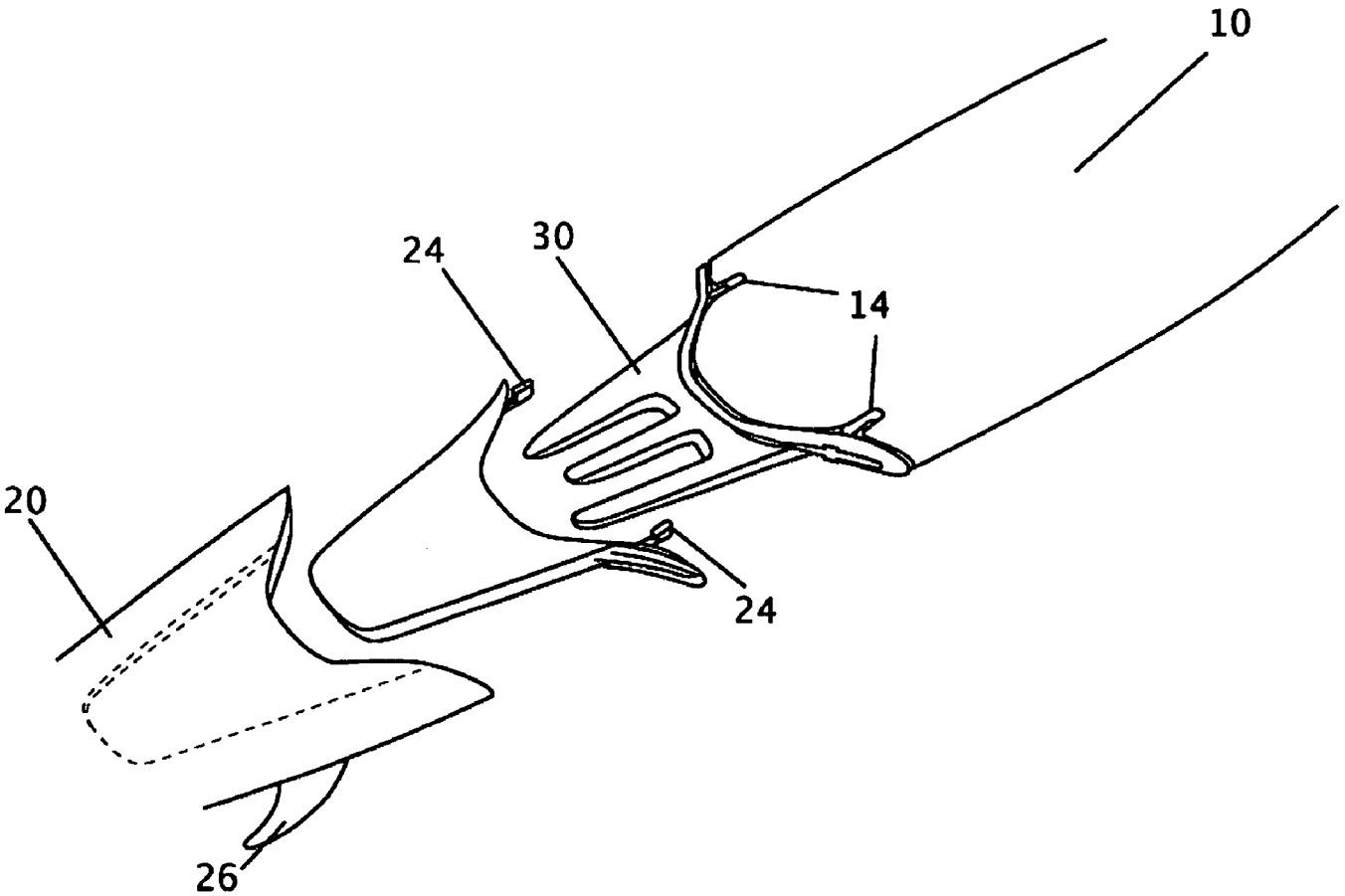

FIGS. 9A, 9B, and 9C show perspective views of alternate embodiments of a variable flex interface. The front edge 11 of the front panel 10 and the rear edge 22 of the rear panel 20 are not shown, since their shapes can vary, as discussed above.

In FIG. 9A, the VFI 30 is u-shaped and includes an opening and is inset into a track or channel on the surface of the receiving panel. In FIG. 9B, the VFI 30 includes two arms (or beams) that insert into a cassette that is completely inside the receiving panel. In the illustrated embodiment, the cassette includes two openings, one for each arm. In FIG. 9C, the VFI 30 includes three arms (or beams) that insert into a cassette that is completely inside the receiving panel. In the illustrated embodiment, the cassette includes one opening, which receives all three arms.

VFI Coupling Mechanism

In one embodiment, the VFI 30 is removably attached to the receiving panel using a variable flex interface coupling mechanism 34. Many types of VFI coupling mechanisms 34 can be used. FIGS. 10A–E show plan views and sectional views of alternate embodiments of a variable flex interface coupling mechanism. The front edge 11 of the front panel 10 and the rear edge 22 of the rear panel 20 are not shown, since their shapes can vary, as discussed above.

Figure 10A:
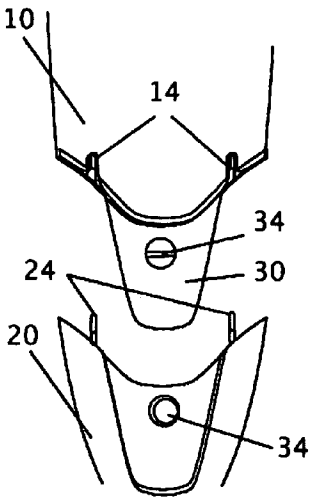
FIGS. 10A–E show plan views and sectional views of alternate embodiments of a variable flex interface coupling mechanism.
Figure 10A:
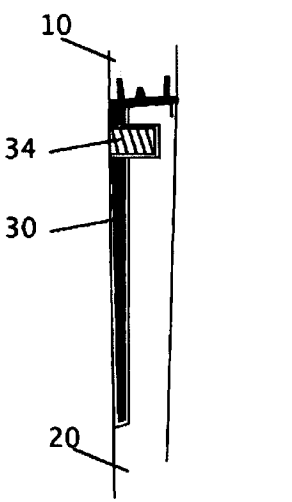
Figure 10B:
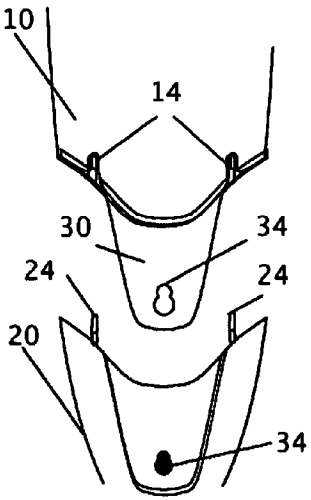
Figure 10B:
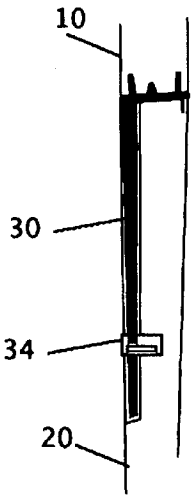
Figure 10C:
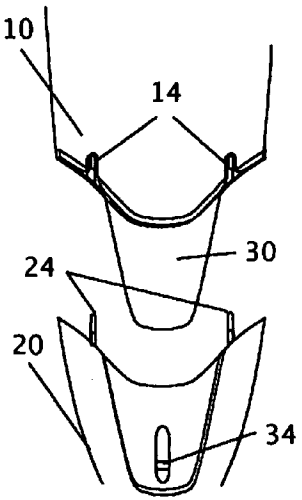
Figure 10C:
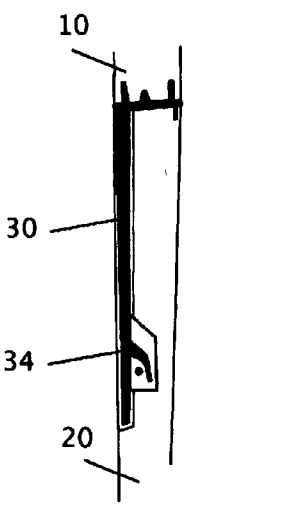
Figure 10E:
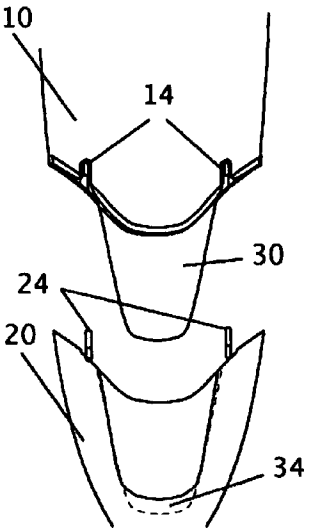
Figure 10E:
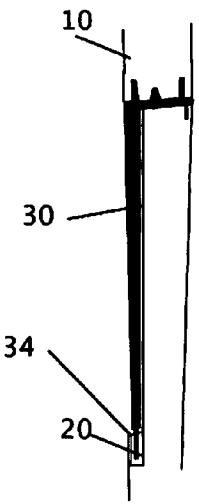
Figure 10D:
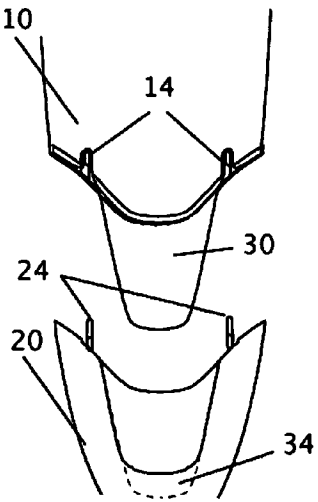
Figure 10D:
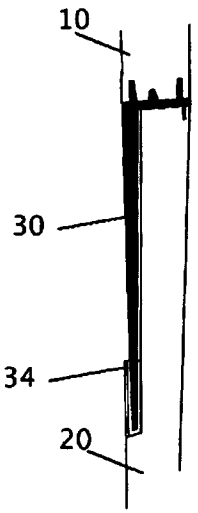

Since the VFI 30 can move during operation (riding) of a board, these embodiments allow for variation in the VFI's location. In FIG. 10A, a screw or quarter lock mechanism connects the VFI 30 to the receiving panel. In one embodiment, flexible materials (e.g., rubber bushings) are placed between the screw (or quarter lock) and the receiving panel to absorb force. In FIG. 10B, a flexible mechanism (e.g., elastomeric rubber) inserts into a slot in the receiving panel. In FIG. 10C, a hook extends downward from the VFI's bottom surface and slides into a slot and bar inset on the top surface of the receiving panel. In FIG. 10D, the rear edge of the VFI 30 inserts into a slot, pocket, or cassette in the receiving panel. In FIG. 10E, a tab extending rearward from the rear edge of the VFI 30 inserts into a slot, pocket, or cassette in the receiving panel. Other VFI coupling mechanisms 34 are also possible, such as tongue and groove interfaces and ratchet interfaces (not shown).

In one embodiment, a VFI coupling mechanism 34 enables a rider to adjust the amount of flex provided by the VFI 30. By adjusting the amount of flex, a rider can adjust how much of his personal force and movement is transferred through the board to the water and vice versa. In one embodiment, the flex is adjusted by varying the position of the VFI 30 relative to the VFI panel (and relative to the receiving panel, since it is coupled to the VFI panel). For example, the VFI's length can be located mostly on (or in) the VFI panel, mostly on (or in) the receiving panel, or divided equally between the two panels. The distribution of the VFI's length between the two panels affects the amount of flex provided by the VFI 30. In one embodiment, the VFI 30 can slide back and forth into and out of the VFI panel and then lock into place.

Figure 11B:
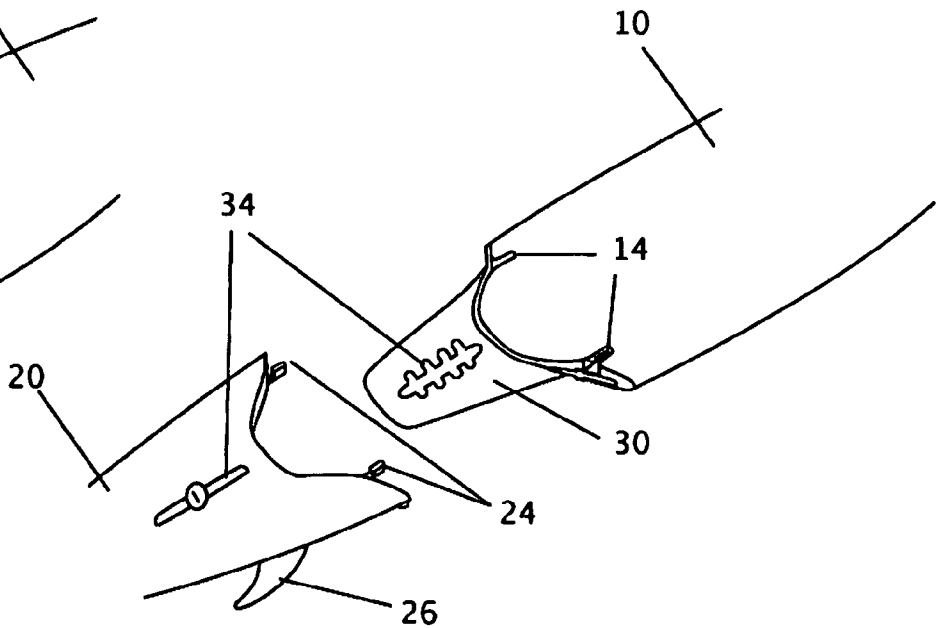
FIGS. 11A and 11B show perspective views of alternate embodiments of a variable flex interface coupling mechanism.
Figure 11A:
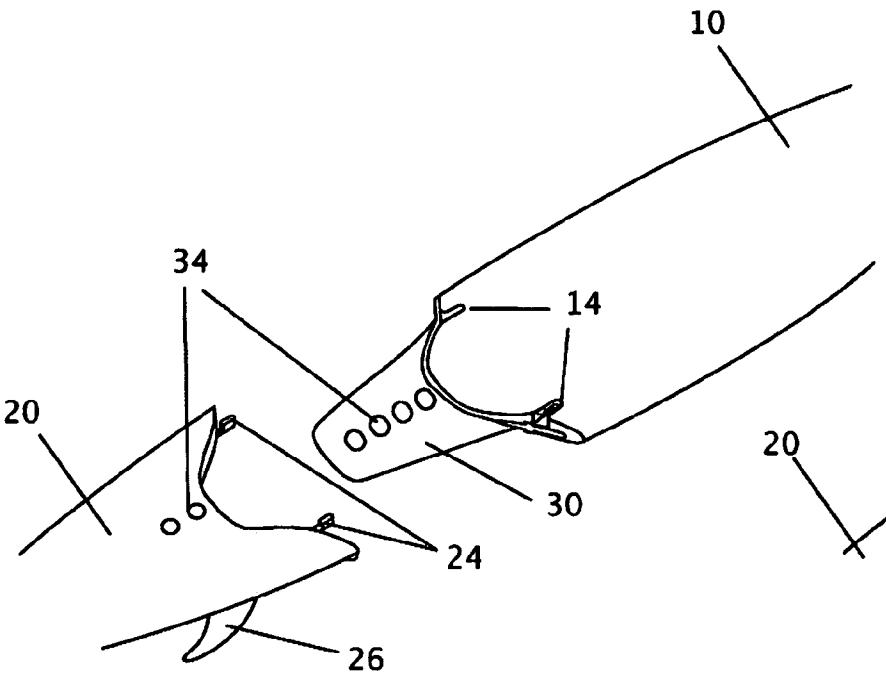

FIGS. 11A and 11B show perspective views of alternate embodiments of a variable flex interface coupling mechanism. The VFI coupling mechanism 34 shown in FIG. 11A is similar to that shown in FIG. 10A, except that the screw or quarter lock mechanism can connect to the receiving panel in multiple positions, thereby enabling adjustment of the flex. In the illustrated embodiment, the VFI 30 can slide back and forth into and out of the VFI panel and then lock into place, depending on which position is desired. The VFI coupling mechanism 34 shown in FIG. 11B is similar to that shown in FIG. 11A, except that the receiving panel includes a different mechanism to enable the screw or quarter lock mechanism to connect in multiple positions. Other types of VFI coupling mechanisms 34, such as hooks, can also enable a rider to adjust the amount of flex provided by the VFI 30. In one embodiment, a VFI coupling mechanism 34 connects to another coupling mechanism, a fin, or a structural element of a panel.

Load-Spreading Element

In one embodiment, a VFI panel includes one or more load-spreading elements 50 that are coupled to the VFI 30 and that help transfer force to and from the VFI 30. For example, a load-spreading element 50 can be a substantially planar member that is oriented vertically and perpendicularly relative to the VFI 30 and that distributes forces applied to the VFI 30. The load-spreading element 50 and the surface it contacts can have substantially complementary surfaces such that they "fit together" when the board is assembled. In one embodiment, these surfaces are oriented perpendicularly relative to the VFI 30. In another embodiment, they deviate from perpendicular, which enables them to have a larger contact surface area for better transferring force. In one embodiment, a load-spreading element 50 coupled to a first panel or adaptor (e.g., via a VFI 30) contacts an interface edge of a second panel or adaptor (e.g., when the board has been assembled). In another embodiment, the load-spreading element 50 contacts a second load-spreading member 50 coupled to a second panel or adaptor.

Load-spreading elements 50 can have various shapes, such as wing-shaped, biscuit-shaped, wedge-shaped, or tongue-and-groove-shaped. In one embodiment, load-spreading elements 50 are wedge-shaped in order to increase the area of engagement when panels (and/or adaptors) are coupled. Load-spreading elements 50 can be located in various places, such as on or near other coupling mechanisms or along the interface edges of the panels.

Figure 12A:
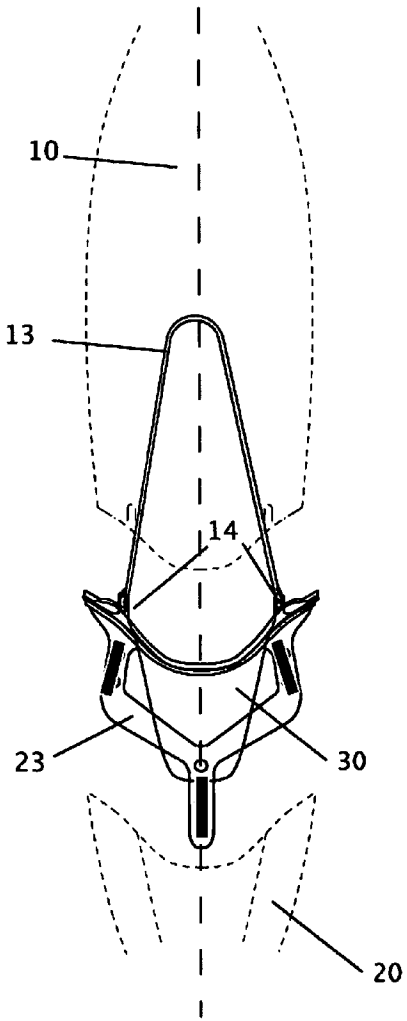
FIG. 12A shows an exploded partial plan view of a surfboard.

FIG. 12A shows an exploded partial plan view of a surfboard. The front panel 10 and the rear panel 20 are shown with dashed lines so as not to obstruct the view of the other parts. In the illustrated embodiment, a front structural element 13 is coupled to a front coupling mechanism 14, which is coupled to a rear coupling mechanism 24 (not shown). The rear coupling mechanism 24 is coupled to a rear structural element 23. The illustrated embodiment also shows a VFI 30 that is coupled to the front panel 10.

Figure 12B:
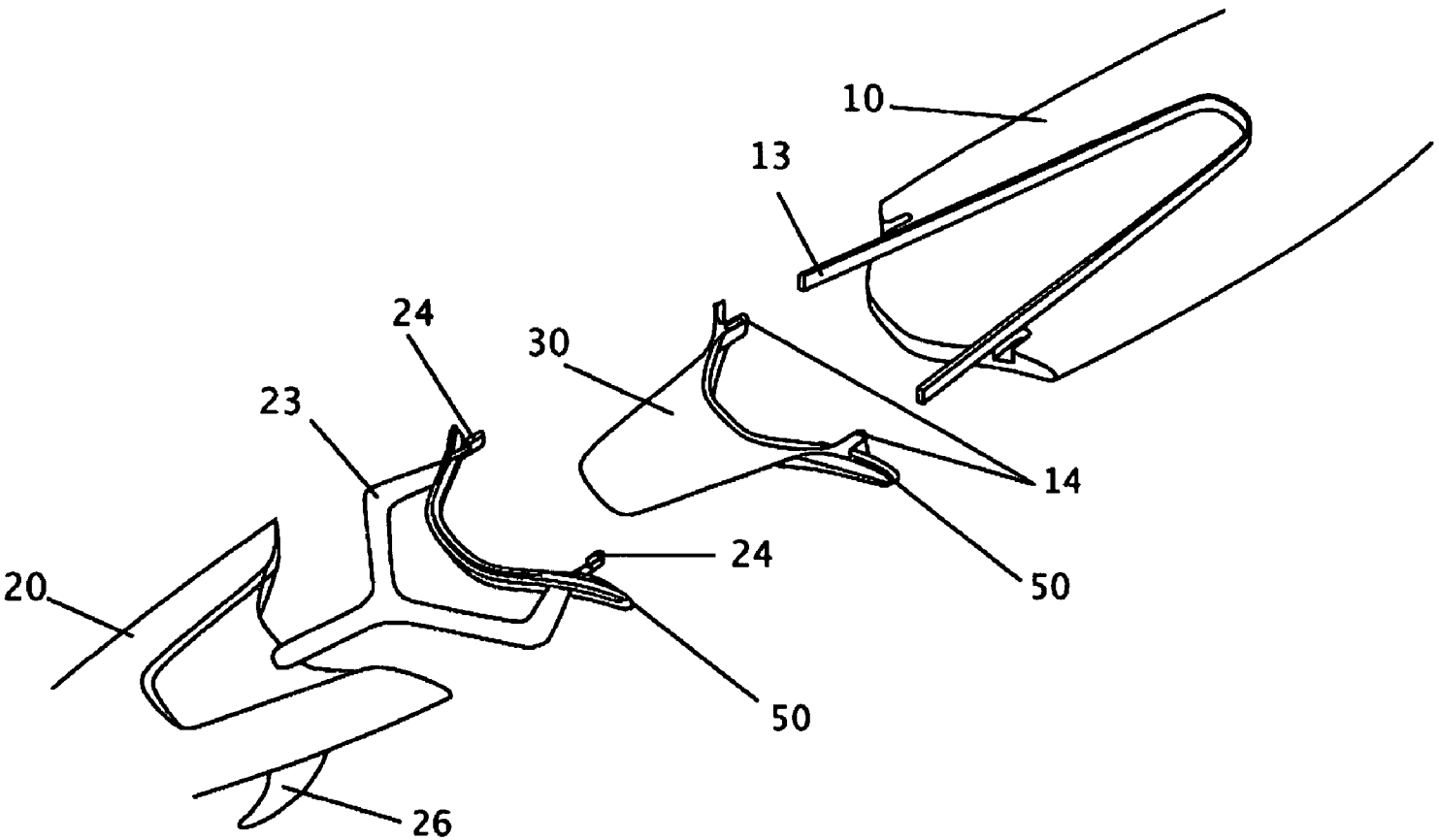
FIG. 12B shows an exploded partial perspective view of the surfboard shown in FIG. 12A.

FIG. 12B shows an exploded partial perspective view of the surfboard shown in FIG. 12A. FIG. 12B is similar to FIG. 12A except that the view is further exploded to show details of some parts. In particular, the front coupling mechanism 14 has been decoupled from the rear coupling mechanism 24. The illustrated embodiment also shows two load spreading elements 50 (one coupled to the front panel 10, and one coupled to the rear panel 20). These two elements 50 fit together when the board is assembled.

Figure 12C:
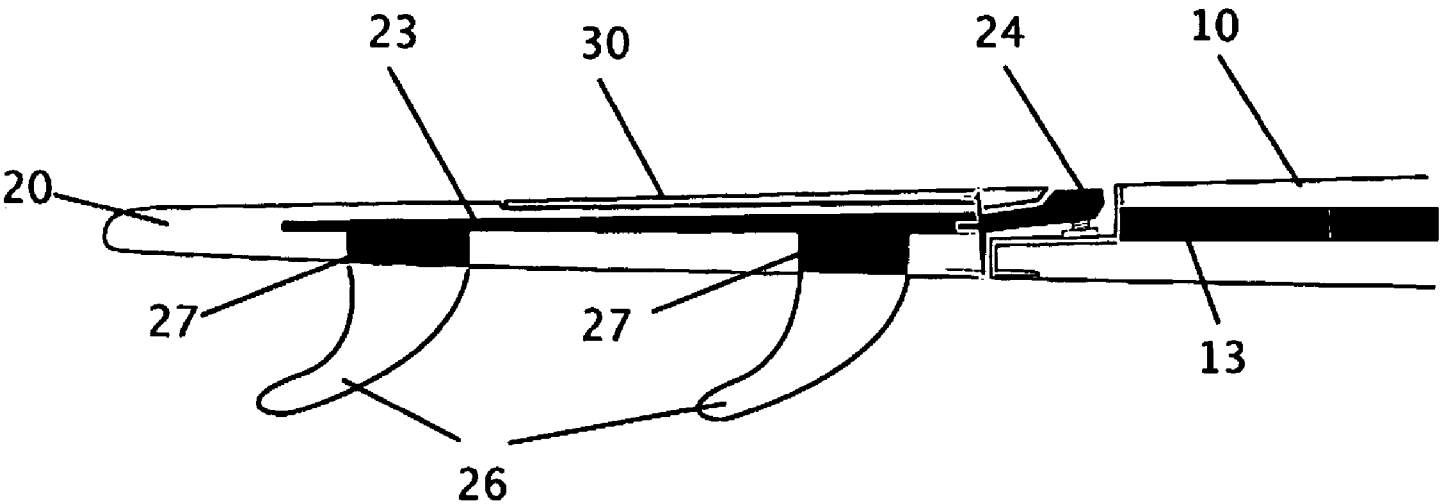
FIG. 12C shows a partial sectional view of the surfboard shown in FIG. 12A.

FIG. 12C shows a partial sectional view of the surfboard shown in FIG. 12A. The illustrated embodiment includes rear fins 26 and rear fin cassettes 27. Note that FIG. 12C is not an exploded view. Thus, FIG. 12C represents the cross-section of an assembled board.

Figure 13A:
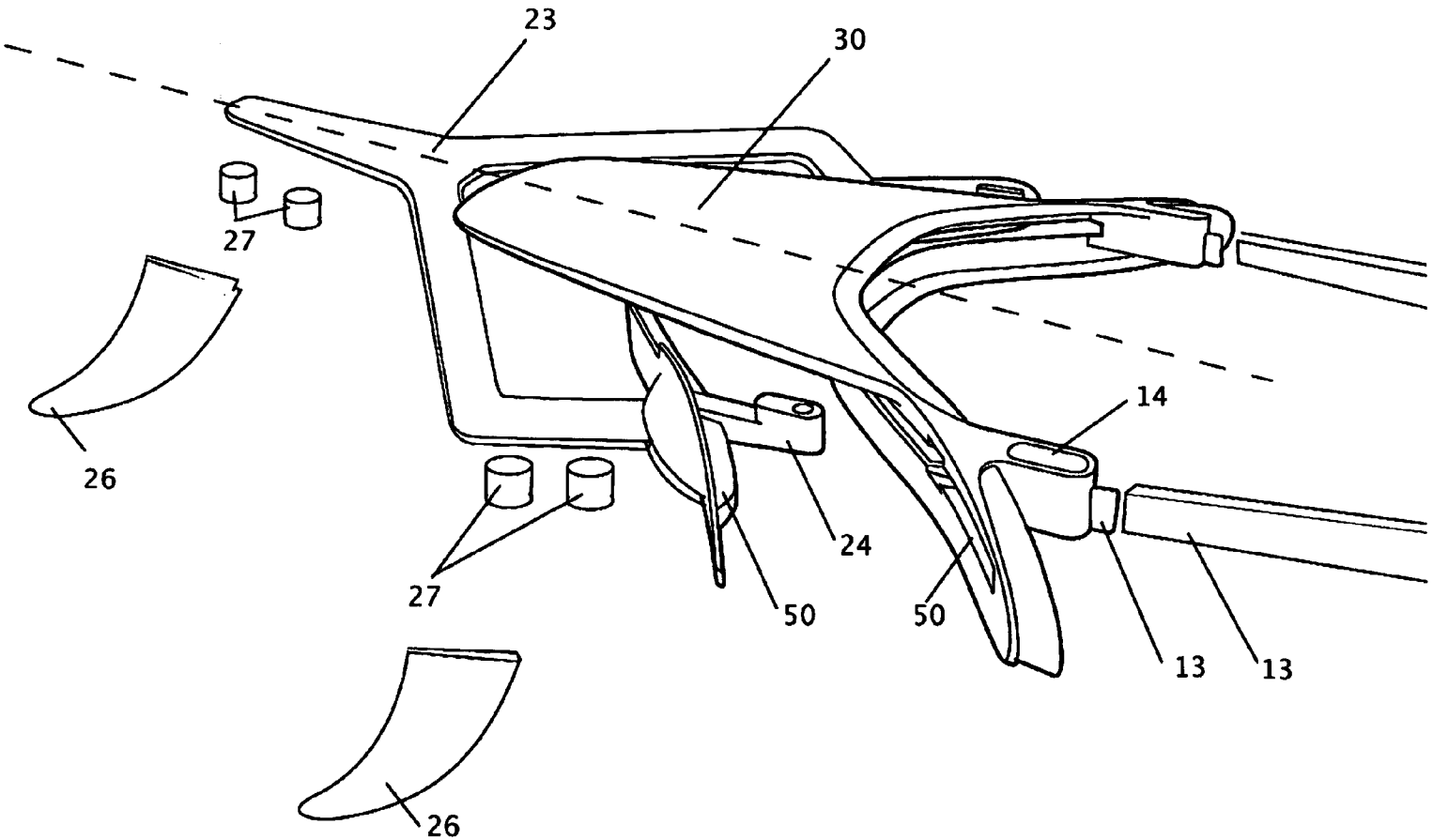
FIG. 13A shows an exploded partial perspective view of a surfboard.

FIG. 13A shows an exploded partial perspective view of a surfboard. The front panel 10 and the rear panel 20 are not shown. In the illustrated embodiment, a front structural element 13 couples to a front coupling mechanism 14, which couples to a rear coupling mechanism 24. The rear coupling mechanism 24 is coupled to a rear structural element 23. The illustrated embodiment also shows rear fins 26, rear fin cassettes 27, and a VFI 30 that is coupled to the front panel 10. The illustrated embodiment also shows two load spreading elements 50 (one coupled to the front panel 10, and one coupled to the rear panel 20), which fit together when the board is assembled.

Figure 13B:
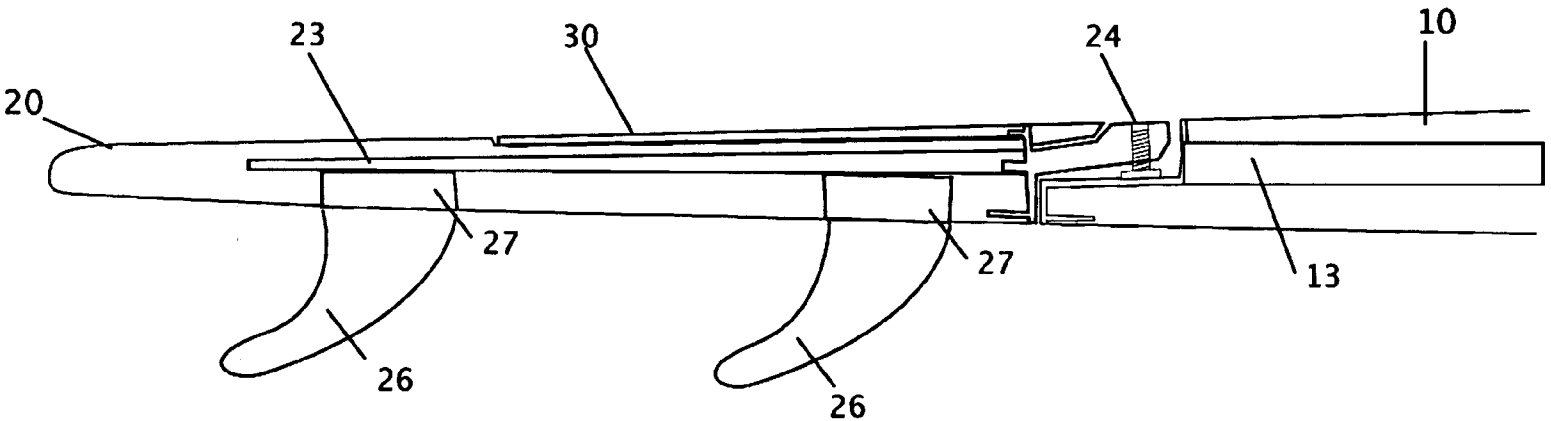
FIG. 13B shows a partial sectional view of the surfboard shown in FIG. 13A.

FIG. 13B shows a partial sectional view of the surfboard shown in FIG. 13A. Note that FIG. 13B is not an exploded view. Thus, FIG. 13B represents the cross section of an assembled board.

Additional Embodiments

Figure 14A:
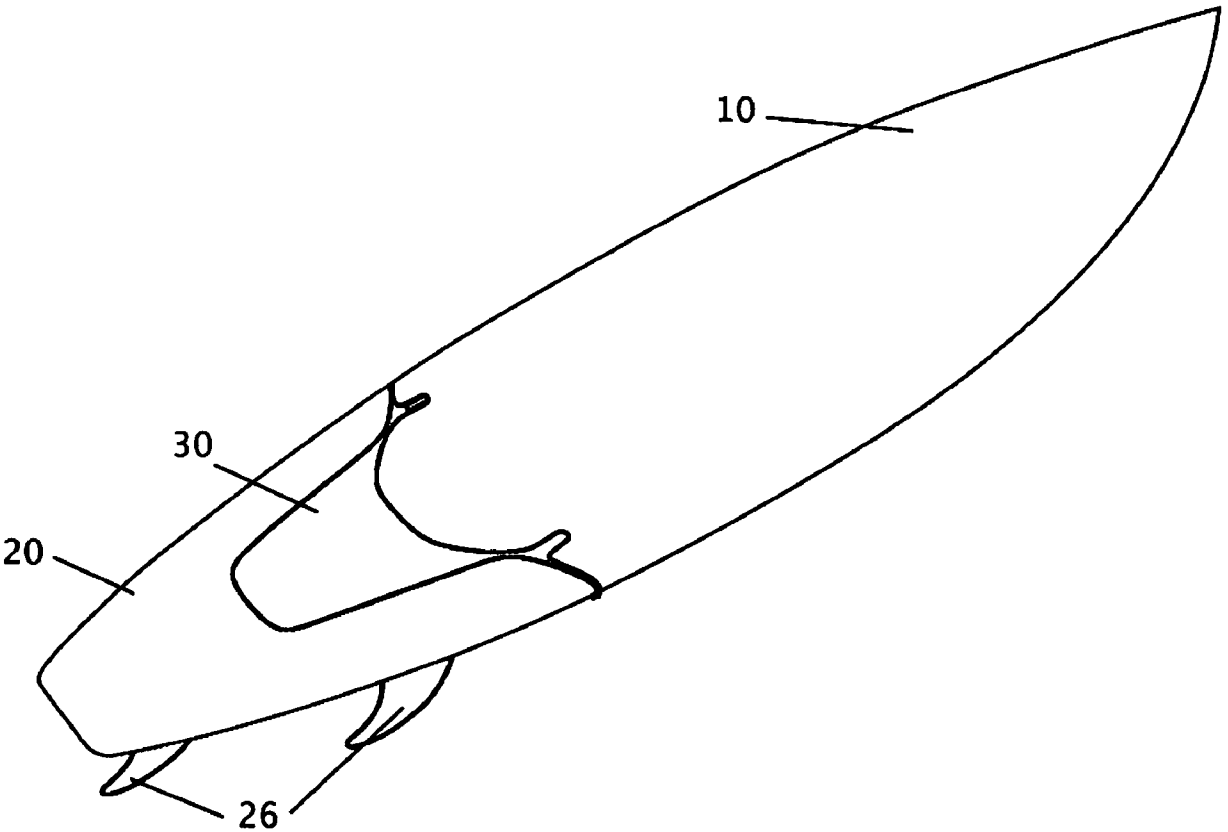
FIG. 14A shows a perspective view of a surfboard that includes coupling mechanisms, a variable flex interface, and variable flex interface coupling mechanisms.
Figure 14B:
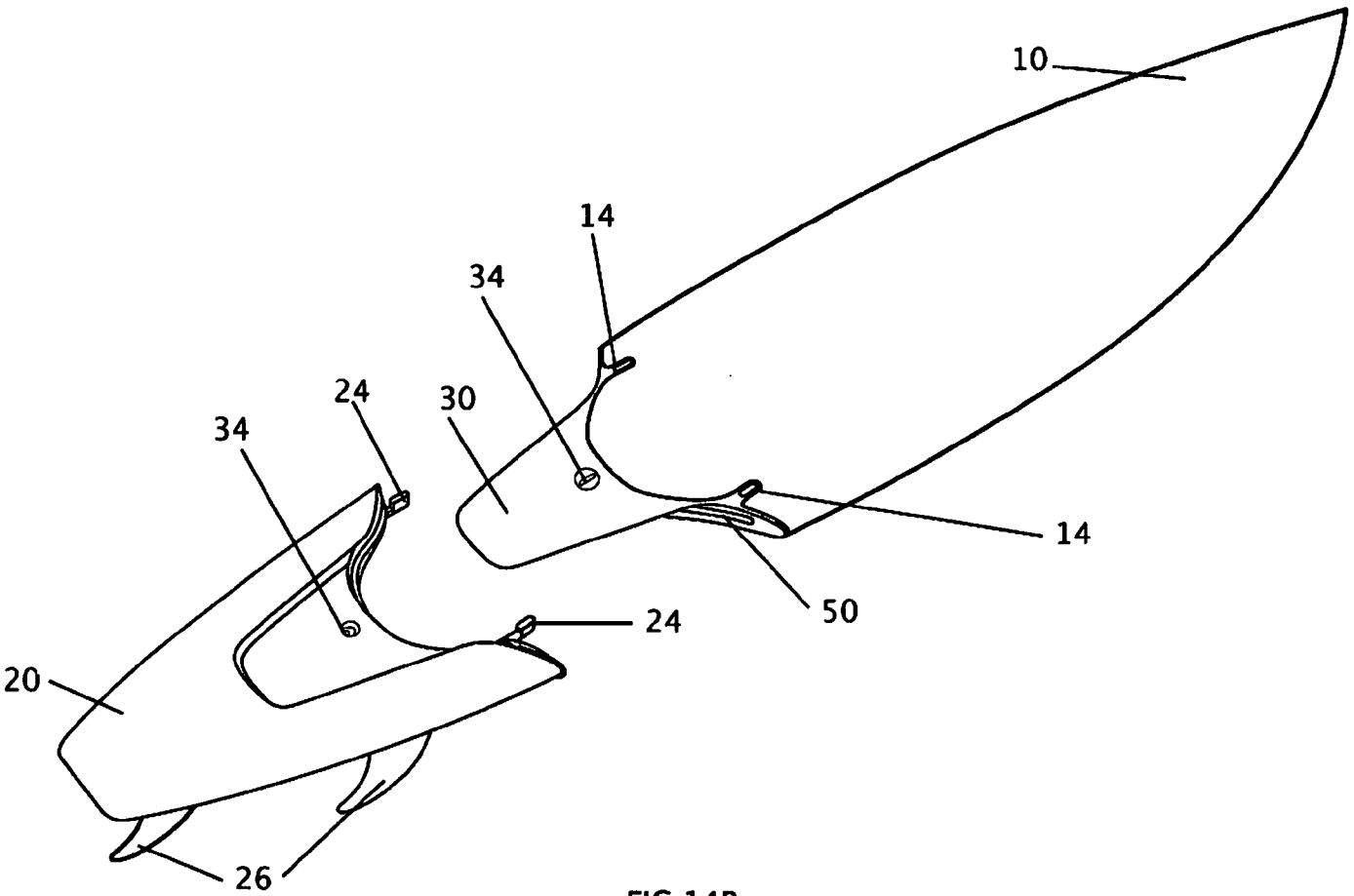
FIG. 14B shows an exploded perspective view of the surfboard shown in FIG. 14A.
Figure 14C:
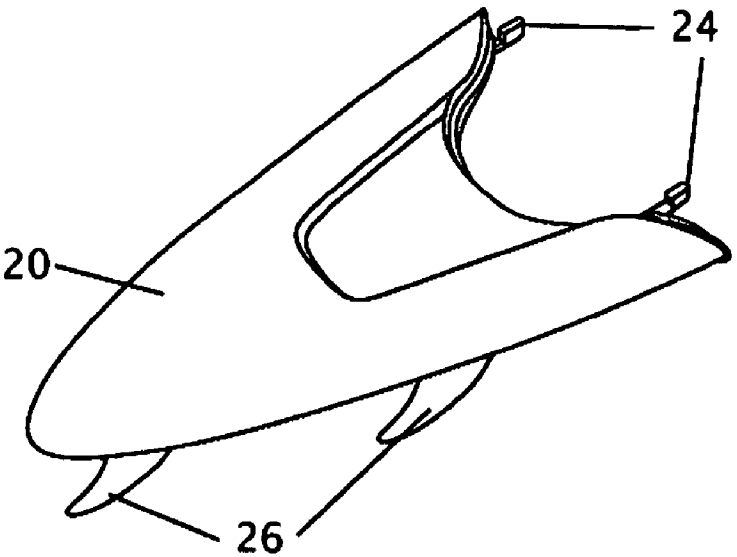
FIG. 14C shows a perspective view of an alternate embodiment of a rear panel.

FIG. 14A shows a perspective view of a surfboard that includes coupling mechanisms, a variable flex interface, and variable flex interface coupling mechanisms. The illustrated embodiment shows a front panel 10 coupled to rear panel 20. Multiple fins 26 are coupled to the rear panel 20. A VFI 30 is also shown. FIG. 14B shows an exploded perspective view of the surfboard shown in FIG. 14A. In this view, the front panel 10 has been decoupled from the rear panel 20. The illustrated embodiment shows front coupling mechanisms 14 and rear coupling mechanisms 24. The illustrated embodiment also shows VFI coupling mechanisms 34 and a load-spreading element 50. FIG. 14C shows a perspective view of an alternate embodiment of a rear panel. This alternate rear panel 20 can connect to the front panel 10 shown in FIG. 14B. The rear edge 22 of the rear panel 20 shown in FIG. 14C has a different shape than the rear edge 22 of the rear panel 20 shown in FIG. 14B.

Although the invention has been described in considerable detail with reference to certain embodiments thereof, other embodiments are possible as will be understood to those skilled in the art.

What is claimed is:

1. A waterboard, comprising:

a front panel having a rear edge;

a rear panel having a front edge adapted to be removably coupled to the rear edge of the front panel; and an interface comprising a flexible material, the interface having a predetermined performance characteristic, wherein a first end of the interface is adapted to be coupled to a selected one of the front panel and the rear panel, and wherein the selected panel comprises a cassette that is adapted to be coupled to the first end of the interface, and wherein a second end of the interface is adapted to extend beyond an edge of the selected panel;

wherein the coupled front panel and rear panel together form a waterboard having a performance characteristic based upon the performance characteristic of the interface.

2. The waterboard of claim 1, further comprising a load-spreading member that is coupled to the interface and that distributes an applied force.

3. The waterboard of claim 1, wherein a portion of the second end of the interface is adapted to be coupled to a panel that is not the selected panel.

4. The waterboard of claim 1, wherein the first end of the interface is adapted to be removably coupled to the selected panel.

5. The waterboard of claim 1, wherein the first end of the interface is adapted to be permanently coupled to the selected panel.

6. The waterboard of claim 1, wherein the first end of the interface is adapted to be integrated into the selected panel.

7. The waterboard of claim 1, wherein the first end of the interface is adapted to be coupled to a structural element of the selected panel.

8. The waterboard of claim 1, wherein the first end of the interface is adapted to be coupled to a fin of the selected panel.

9. A waterboard, comprising:

a front panel having a rear edge;

a rear panel having a front edge adapted to be removably coupled to the rear edge of the front panel; and an interface comprising a flexible material, the interface having a predetermined performance characteristic, wherein a first end of the interface is adapted to be coupled to a selected one of the front panel and the rear panel, and wherein a second end of the interface is adapted to extend beyond an edge of the selected panel, and wherein a portion of the second end of the interface overlaps a surface of a panel that is not the selected panel;

wherein the coupled front panel and rear panel together form a waterboard having a performance characteristic based upon the performance characteristic of the interface.

10. The waterboard of claim 9, further comprising a load-spreading member that is coupled to the interface and that distributes an applied force.

11. The waterboard of claim 9, wherein a portion of the second end of the interface is adapted to be coupled to a panel that is not the selected panel.

12. The waterboard of claim 9, wherein the first end of the interface is adapted to be removably coupled to the selected panel.

13. The waterboard of claim 9, wherein the first end of the interface is adapted to be permanently coupled to the selected panel.

14. The waterboard of claim 9, wherein the first end of the interface is adapted to be integrated into the selected panel.

15. The waterboard of claim 9, wherein the first end of the interface is adapted to be coupled to a structural element of the selected panel.

16. The waterboard of claim 9, wherein the first end of the interface is adapted to be coupled to a fin of the selected panel.

17. A waterboard, comprising:

a front panel having a rear edge;

a rear panel having a front edge adapted to be removably coupled to the rear edge of the front panel; and an interface comprising a flexible material, the interface having a predetermined performance characteristic, wherein a first end of the interface is adapted to be coupled to a selected one of the front panel and the rear panel, and wherein a second end of the interface is adapted to extend beyond an edge of the selected panel, and wherein a portion of the second end of the interface extends into an enclosed cavity of a panel that is not the selected panel;

wherein the coupled front panel and rear panel together form a waterboard having a performance characteristic based upon the performance characteristic of the interface.

18. The waterboard of claim 17, further comprising a load-spreading member that is coupled to the interface and that distributes an applied force.

19. The waterboard of claim 17, wherein a portion of the second end of the interface is adapted to be coupled to a panel that is not the selected panel.

20. The waterboard of claim 17, wherein the first end of the interface is adapted to be removably coupled to the selected panel.

21. The waterboard of claim 17, wherein the first end of the interface is adapted to be permanently coupled to the selected panel.

22. The waterboard of claim 17, wherein the first end of the interface is adapted to be integrated into the selected panel.

23. The waterboard of claim 17, wherein the first end of the interface is adapted to be coupled to a structural element of the selected panel.

* * * * *